US005112713A

United States Patent [19]

Kato et al.

[11] Patent Number: 5,112,713

[45] Date of Patent: May 12, 1992

[54] ELECTROPHOTOGRAPHIC PHOTORECEPTOR WITH POLAR GROUP CONTAINING COMB-TYPE RESIN BINDER

[75] Inventors: Eiichi Kato; Kazuo Ishii, both of Shizuoka, Japan

[73] Assignee: Fuji Photo Film Co., Ltd., Kanagawa, Japan

[21] Appl. No.: 527,451

[22] Filed: May 23, 1990

[30] Foreign Application Priority Data

May 23, 1989 [JP] Japan ..... 1-127819

[51] Int. Cl.[5] ..... G03G 5/087

[52] U.S. Cl. ..... 430/96

[58] Field of Search ..... 430/96

[56] References Cited

U.S. PATENT DOCUMENTS 4,968,372 11/1990 Kato et al. ..... 430/96
5,021,311 6/1991 Kato et al. ..... 430/96
5,030,534 7/1991 Kato et al. ..... 430/96

FOREIGN PATENT DOCUMENTS 0307227 3/1989 European Pat. Off. .
1806414 8/1969 Fed. Rep. of Germany .

OTHER PUBLICATIONS

Patent Abstracts of Japan, vol. 13, No. 12, Jan. 12, 1990.
Patent Abstracts of Japan, vol. 13, No. 9, Jan. 11, 1989.

*Primary Examiner*—John Goodrow
*Attorney, Agent, or Firm*—Sughrue, Mion, Zinn, Macpeak & Seas

[57] ABSTRACT

An electrophotographic light-sensitive material comprising a support having thereon a photoconductive layer containing at least inorganic photoconductive particles and a binder resin, wherein the binder resin contains (A) at least one resin comprising a graft copolymer having a weight average molecular weight of from $1.0\times10^3$ to $2.0\times10^4$ and containing, as copolymer components, at least (A-i) a monofunctional macromonomer having a weight average molecular weight of not more than $2\times10^4$.

10 Claims, No Drawings

ELECTROPHOTOGRAPHIC PHOTORECEPTOR WITH POLAR GROUP CONTAINING COMB-TYPE RESIN BINDER

FIELD OF THE INVENTION

This invention relates to an electrophotographic light-sensitive material, and more particularly to an electrophotographic light-sensitive material having excellent electrostatic characteristics, moisture resistance, and durability.

BACKGROUND OF THE INVENTION

An electrophotographic light-sensitive material may have various structures depending on the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Further, a process of using an electrophotographic light-sensitive material as an offset master plate precursor for direct plate making is widely practiced.

Binders which are used for forming the photoconductive layer of an electrophotographic light-sensitive material are required to have film-forming properties by themselves and the capability if dispersing a photoconductive powder therein. Also, the photoconductive layer formed using the binder should have satisfactory adhesion to a base material or support. The photoconductive layer formed by using the binder also must have various electrostatic characteristics and image-forming properties, such that the photoconductive layer exhibits high charging capacity, small dark decay and large light decay, hardly undergoes fatigue before exposure, and maintains these characteristics in a stable manner against change of humidity at the time of image formation.

Binder resins which have been conventionally used include silicone resins (see JP-B-34-6670, the term "JP-B" as used herein means an "examined published Japanese patent application"), styrene-butadiene resins (see JP-B-35-1960), alkyd resins, maleic acid resins, and polyamide (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510, and JP-B-41-13946), etc. However, electrophotographic light-sensitive materials using these known resins have a number of disadvantages, i.e., poor affinity for a photoconductive powder (poor dispersion of a photoconductive coating composition); low photoconductive layer charging properties; poor reproduced image quality, particularly dot reproducibility or resolving power; susceptibility of the reproduced image quality to influences from the environment at the time of electrophotographic image formation, such as high temperature and high humidity conditions or low temperature and low humidity conditions; and insufficient film strength or adhesion of the photoconductive layer, which causes, when the light-sensitive material is used for an offset master, peeling of the photoconductive layer during offset printing thus failing to obtain a large number of prints; and the like.

To improve the electrostatic characteristics of a photoconductive layer, various approaches have hitherto been taken. For example, incorporation of a compound containing an aromatic ring or furan ring containing a carboxyl group or nitro group either alone or in combination with a dicarboxylic acid anhydride into a photoconductive layer has been proposed as disclosed in JP-B-42-6878 and JP-B-45-3073. However, the thus improved electrophotographic light-sensitive materials still have insufficient electrostatic characteristics, particularly light decay characteristics. The insufficient sensitivity of these light-sensitive materials has been compensated for by incorporating a large quantity of a sensitizing dye into the photoconductive layer. However, light-sensitive materials containing a large quantity of a sensitizing dye undergo considerable deterioration of whiteness to reduce the quality as a recording medium, sometimes causing a deterioration in dark decay characteristics, resulting in a failure to obtain a satisfactory reproduced image.

On the other hand, JP-A-60-10254 (the term "JP-A" as used herein means an "unexamined published Japanese patent application") suggests control of the average molecular weight of a resin to be used as a binder of the photoconductive layer. According to this suggestion, the combined use of an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ would improve the electrostatic characteristics (particularly reproducibility as a PPC light-sensitive material on repeated use), moisture resistance, and the like.

In the field of lithographic printing plate precursors, extensive studies have been conducted to provide binder resins for a photoconductive layer having electrostatic characteristics compatible with printing characteristics. Examples of binder resins so far reported to be effective for oil-desensitization of a photoconductive layer include a resin having a molecular weight of from $1.8\times10^4$ to $10\times10^4$ and a glass transition point of from 10° C. to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit with a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; and a terpolymer containing a (meth)acrylic ester unit with an alkyl group having from 6 to 12 carbon atoms as a substituent and a vinyl monomer containing a carboxyl group as disclosed in JP-A-58-68046.

However, none of these resins proposed has proved to be satisfactory for practical use in charging properties, dark charge retention, photosensitivity, and surface smoothness of the photoconductive layer.

The binder resins proposed for use in electrophotographic lithographic printing plate precursors were also proved by actual evaluations to give rise to problems relating to electrostatic characteristics and background staining of prints.

In order to solve these problems, it has been proposed to use, as a binder resin, a low-molecular weight resin (molecular weight: $1\times10^3$ to $1\times10^4$) containing from 0.05 to 10% by weight of a copolymer component having an acid group in the side chain thereof to thereby improve surface smoothness and electrostatic characteristics of the photoconductive layer and to obtain background stain-free images as disclosed in JP-A-63-217354. It has also been proposed to use such a low-molecular weight resin in combination with a high-molecular weight resin (molecular weight: $1\times10^4$ or more) to thereby obtain sufficient film strength of the photoconductive layer to improve printing durability without impairing the above-described favorable characteristics as disclosed in JP-A-64-564, JP-A-63-220148 and JP-A-63-220149

It has turned out, however, that use of these resins is still insufficient for stably maintaining performance properties in cases when the environmental conditions greatly change from high-temperature and high-humidity conditions to low-temperature and low-humidity conditions. In particular, in a scanning exposure system using a semi-conductor laser beam, the exposure time becomes longer and also there is a restriction on the exposure intensity as compared to a conventional overall simultaneous exposure system using a visible light and, hence, higher performance with respect to electrostatic characteristics, and particularly dark charge retention and photosensitivity has been demanded.

SUMMARY OF THE INVENTION

An object of this invention is to provide an electrophotographic light-sensitive material having stable and excellent electrostatic characteristics and providing clear images of high quality unaffected by variations in environmental conditions at the time of reproduction of an image, such as a change to low-temperature and low-humidity conditions or to high-temperature and high-humidity conditions.

Another object of this invention is to provide a CPC electrophotographic light-sensitive material having excellent electrostatic characteristics with small changes due to environmental changes.

A further object of this invention is to provide an electrophotographic light-sensitive material effective for a scanning exposure system using a semi-conductor laser beam.

A still further object of this invention is to provide an electrophotographic lithographic printing plate precursor having excellent electrostatic characteristics (particularly dark charge retention and photosensitivity), capable of providing a reproduced image having high fidelity to an original, causing neither overall background stains nor dotted background stains of prints, and having excellent printing durability.

It has now been found that the above objects of this invention are accomplished by an electrophotographic light-sensitive material comprising a support having thereon a photoconductive layer containing at least inorganic photoconductive particles and a binder resin, wherein the binder resin contains (A) at least one resin comprising a graft copolymer having a weight average molecular weight of from $1.0\times10^3$ to $2.0\times10^4$ and containing, as copolymer components, at least (A-i) a monofunctional macromonomer having a weight average molecular weight of not more than $2\times10^4$ and containing at least one polymer component represented by formula (IIa) or (IIb) shown below and at least one polymer component having at least one polar group selected from the group consisting of —COOH, $-PO_3H_2$, $-SO_3H$, —OH, and

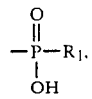

wherein $R_1$ represents a hydrocarbon group or $-OR_2$ (wherein $R_2$ represents a hydrocarbon group), with a polymerizable double bond group represented by formula (I) shown below being bonded to one terminal of the main chain thereof, and (A-ii) a monomer represented by formula (III) shown below, and (B) at least one resin comprising a copolymer containing, as copolymer components, at least (B-i) a monofunctional macromonomer having a weight average molecular weight of not more than $2\times10^4$ and containing at least one polymer component represented by formula (IIa) or (IIb) shown below, with a polymerizable double bond group represented by formula (I) shown below being bonded to one terminal of the main chain thereof and (B-ii) a monomer represented by formula (III) shown below.

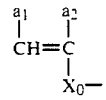

(I)

wherein $X_0$ represents —COO—, —OCO—, $-CH_2OCO-$, $-CH_2COO-$, —O—, $-SO_2-$, —CO—, —CONHCOO—, —CONHCONH—, $-CONHSO_2-$,

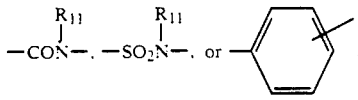

wherein $R_{11}$ represents a hydrogen atom or a hydrocarbon group; $a_1$ and $a_2$, which may be the same or different, each represents a hydrogen atom, a halogen atom, a cyano group, a hydrocarbon group, $-COO-Z_1$, or $-COO-Z_1$ bonded through a hydrocarbon group (wherein $Z_1$ represents a substituted or unsubstituted hydrocarbon group.

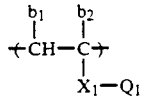

(IIa)

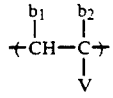

(IIb)

wherein $X_1$ has the same meaning as $X_0$; $Q_1$ represents an aliphatic group having from 1 to 18 carbon atoms or an aromatic group having from 6 to 12 carbon atoms; $b_1$ and $b_2$, which may be the same or different, each has the same meaning as $a_1$ and $a_2$; V represents —CN, $-CONH_2$, or

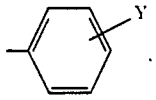

wherein Y represents a hydrogen atom, a halogen atom, a hydrocarbon group, an alkoxyl group, or $-COOZ_2$, wherein $Z_2$ represents an alkyl group, an aralkyl group, or an aryl group.

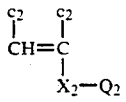

(III)

wherein $X_2$ has the same meaning as $X_0$ in formula (I); $Q_2$ has the same meaning as $Q_1$ in formula (IIa); and $c_1$ and $c_2$, which may be the same or different, have the same meaning as $a_1$ and $a_2$ in formula (I).

That is, the binder resin which can be used in the present invention comprises at least a low-molecular weight graft copolymer containing at least (A-i) a monofunctional macromonomer containing a polar group-containing polymer component (hereinafter referred to as macromonomer (MA)) and (A-ii) a monomer represented by formula (III) (hereinafter referred to as resin (A)) and a graft copolymer containing at least (B-i) a monofunctional macromonomer (hereinafter referred to as macromonomer (MB)) and a monomer represented by formula (III) (hereinafter referred to as resin (B)).

In one embodiment of the present invention, resin (A) is a resin in which the graft copolymer has at least one polar group selected from the group consisting of $-PO_3H_2$, $-SO_3H$, $-COOH$, $-OH$, and

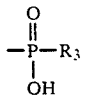

(wherein $R_3$ represents a hydrocarbon group or $-OR_4$, wherein $R_4$ represents a hydrocarbon group) at one terminal of the main chain thereof (hereinafter sometimes referred to as resin (A')).

DETAILED DESCRIPTION OF THE INVENTION

As described above, conventional acidic group-containing binder resins have been developed chiefly for use in offset master plates and, hence, have a high molecular weight (e.g., $5\times10^4$ or even more) so as to assure film strength sufficient for improving printing durability. Moreover, these known copolymers are random copolymers in which the acidic group-containing copolymer component is randomly present in the polymer main chain thereof.

To the contrary, resin (A) of the present invention is a graft copolymer, in which the acidic group or hydroxyl group (polar group) is not randomized in the main chain thereof but is bonded at specific position(s), i.e., in the grafted portion at random or, in addition, at the terminal of the main chain thereof.

Accordingly, it is assumed that the polar group moiety existing at a specific position apart from the main chain of the copolymer is adsorbed onto stoichiometric defects of inorganic photoconductive particles, while the main chain portion of the copolymer mildly and sufficiently cover the surface of the photoconductive particles. Electron traps of the photoconductive particles can thus be compensated for and humidity resistance can be improved, while aiding sufficient dispersion of the photoconductive particles without agglomeration. It also turned out that high electrophotographic performance can be maintained in a stable manner irrespective of variations in environmental conditions from high-temperature and high-humidity conditions to low-temperature and low-humidity conditions. Resin (B) serves to sufficiently increasing mechanical strength of the photoconductive layer which is insufficient in case of using resin (A) alone, without impairing the excellent electrophotographic characteristics obtained by using resin (A). The present invention is particularly effective in a scanning exposure system using a semi-conductor laser as a light source.

The photoconductive layer obtained by the present invention has improved surface smoothness. If a light-sensitive material to be used as a lithographic printing plate precursor is prepared from a non-uniform dispersion of photoconductive particles in a binder resin with agglomerates being present, the photoconductive layer has a rough surface. As a result, non-image areas cannot be rendered uniformly hydrophilic by oil-desensitization treatment with an oil-desensitizing solution. This being the case, the resulting printing plate induces adhesion of a printing ink to the non-image areas on printing, which phenomenon leads to background stains in the non-image areas of prints.

It was also confirmed that the resin binder of the present invention exhibits satisfactory photosensitivity as compared with random copolymer resins containing a polar group in the side chain bonded to the main chain thereof.

Spectral sensitizing dyes which are usually used for imparting photosensitivity in the region of from visible light to infrared light exert their full spectral sensitizing action through adsorption on photoconductive particles. From this fact, it is believed that the binder resin containing the copolymer of the present invention properly interacts with photoconductive particles without hindering the adsorption of a spectral sensitizing dye on the photoconductive particles. This action of the binder resin is particularly pronounced in using cyanine dyes or phthalocyanine pigments which are particularly effective as spectral sensitizing dyes for sensitization in the region of from near infrared to infrared.

When only the low-molecular weight resin (A) is used alone as a binder resin, it is sufficiently adsorbed onto photoconductive particles to cover the surface of the particles so that surface smoothness and electrostatic characteristics of the photoconductive layer can be improved and stain-free images can be obtained. Also, the film strength of the resulting light-sensitive material suffices for use as a CPC light-sensitive material or as an offset printing plate precursor for production of an offset printing plate to be used for obtaining around a thousand prints. Here, a combined use of resin (B) achieves further improvement in mechanical film strength which may be still insufficient when in using resin (A) alone without impairing the functions of resin (A) at all. Therefore, the electrophotographic light-sensitive material according to the present invention has excellent electrostatic characteristics irrespective of variations in environmental conditions as well as sufficient film strength, thereby making it possible to provide an offset master plate having a printing durability amounting to 6000 to 7000 prints even under severe printing conditions (such as under an increased printing pressure in using a large-sized printing machine).

In a preferred embodiment of the present invention, resin (B) is a graft copolymer having at least one acidic group selected from the group consisting of $-PO_3H_2$, $-SO_3H$, —COOH, —OH, —SH, and

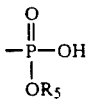

(wherein $R_5$ represents a hydrocarbon group) at one terminal of the polymer main chain thereof (hereinafter sometimes referred to as resin (B')).

Resin (B'), when used in combination with resin (A), provides an electrophotographic light-sensitive material having further improved electrostatic characteristics, especially DRR (dark decay retention) and $E_{1/10}$ (photosensitivity), without impairing the excellent characteristics brought about by the use of resin (A). These effects undergo substantially no change irrespective of variations in environmental conditions, such as a change to a high temperature, a high humidity, a low temperature, or a low humidity. Moreover, the resulting electrophotographic light-sensitive material has further enhanced film strength, which leads to improved printing durability.

Resin (A) is a low-molecular weight graft copolymer containing (A-i) monofunctional macromonomer (MA) containing a polymer component represented by formulae (IIa) and/or (IIb) and a polar group-containing polymer component and (A-ii) a monomer represented by formula (III).

In resin (A), the graft copolymer has a weight average molecular weight of from $1\times10^3$ to $2\times10^4$, and preferably from $3\times10^3$ to $1\times10^4$, and contains from 5 to 80% by weight, and preferably from 10 to 60% by weight, of macromonomer (MA). Where the copolymer contains a polar group at the terminal of the main chain thereof, the content of the polar group in the copolymer ranges from 0.5 to 15% by weight, and preferably from 1 to 10% by weight. Resin (A) preferably has a glass transition point of from −20° C. to 120° C., and preferably from −10° C. to 90° C.

If the molecular weight of resin (A) is less than $1\times10^3$, the film-forming properties of the binder are reduced, and sufficient film strength is not retained. If it exceeds $2\times10^4$, the electrophotographic characteristics, and particularly initial potential and dark decay retention, are degraded. Deterioration of electrophotographic characteristics is particularly conspicuous in using such a high-molecular weight polymer with a polar group content exceeding 3% by weight, resulting in considerable deterioration of electrophotographic characteristics leading to noticeable background staining when used as an offset master.

If the content of the polar group in resin (A) (i.e., the polar group in the grafted portion and any arbitrary polar group at the terminal of the main chain) is less than 0.5% by weight, the initial potential is too low for a sufficient image density to be obtained. If it exceeds 15% by weight, dispersibility is reduced, film smoothness and humidity resistance are reduced, and background stains are increased when the light-sensitive material is used as an offset master.

On the other hand, resin (B) is a graft copolymer containing at least (B-i) monofunctional macromonomer (MB) containing a polymer component represented by formulae (IIa) and/or (IIb) and (B-ii) a monomer represented by formula (III).

Resin (B) is preferably a graft copolymer resin having a weight average molecular weight of $5\times10^4$ or more, and more preferably from $5\times10^4$ to $3\times10^5$.

Resin (B) preferably has a glass transition point ranging from 0° C. to 120° C., and more preferably from 10° C. to 95° C.

Monofunctional macromonomer (MA) which is a copolymer component of the graft copolymer resin (A) and monofunctional macromonomer (MB) which is a copolymer component of the graft copolymer resin (B) are described below.

Macromonomer (MA) is a compound having a weight average molecular weight of not more than $2\times10^4$ and containing at least one polymer component represented by formula (IIa) or (IIb) and at least one polymer component containing a specific polar group (—COOH, $-PO_3H_2$, $-SO_3H$, —OH, and/or

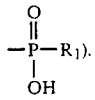

with a polymerizable double bond group represented by formula (I) being bonded to one terminal of the polymer main chain thereof.

Macromonomer (MB) is a compound having a weight average molecular weight of not more than $2\times10^4$ and containing at least one polymer component represented by formula (IIa) or (IIb), with a polymerizable double bond group represented by formula (I) being bonded to one terminal of the polymer main chain thereof.

Components common in resin (A) and resin (B), i.e., the component of formulae (I), (IIa), (IIb), or (III), may be the same or different between resins (A) and (B).

In formulae (I), (IIa) and (IIb), hydrocarbon groups in $a_1$, $a_2$, $X_0$, $b_1$, $b_2$, $X_1$, $Q_1$ and V include substituted hydrocarbon groups and unsubstituted hydrocarbon groups, the number of carbon atoms previously recited being for the unsubstituted ones.

In formula (I), $X_0$ represents —COO—, —OCO—, $-CH_2OCO-$, $-CH_2COO-$, —O—, $-SO_2-$, —CO—, —CONHCOO—, —CONHCONH—, $-CONHSO_2-$,

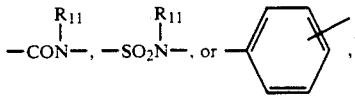

wherein $R_{11}$ represents a hydrogen atom or a hydrocarbon group. Specific examples of preferred hydrocarbon groups as $R_{11}$ are a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atoms (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

Where $X_0$ is

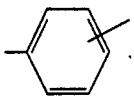

the benzene ring may be substituted with, for example, a halogen atom (e.g., chlorine and bromine), an alkyl group (e.g., methyl, ethyl, propyl, butyl, chloromethyl, and methoxymethyl), and an alkoxyl group (e.g., methoxy, ethoxy, propoxy, and butoxy).

$a_1$ and $a_2$, which may be the same or different, each preferably represents a hydrogen atom, a halogen atom (e.g., chlorine, bromine, and fluorine), a cyano group, an alkyl group having from 1 to 4 carbon atoms (e.g., methyl, ethyl, propyl, and butyl), $—COOZ_1$ or $—COOZ_1$ bonded via a hydrocarbon group (wherein $Z_1$ preferably represents a hydrogen atom, a substituted or unsubstituted alkyl group having from 1 to 18 carbon atoms, a substituted or unsubstituted alkenyl group, a substituted or unsubstituted aralkyl group, a substituted or unsubstituted alicyclic group, or a substituted or unsubstituted aryl group, specifically including those enumerated above with respect to $R_{11}$).

The hydrocarbon group in $—COO-Z_1$ bonded via a hydrocarbon group includes methylene, ethylene, and propylene groups.

More preferably, $X_0$ represents —COO—, —OCO—, $—CH_2COO—$, $—CH_2OCO—$, —O—, —CONHCOO—, —CONHCONH—, —CONH—, $—SO_2NH—$, or

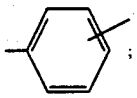

and $a_1$ and $a_2$, which may be the same or different, each represents a hydrogen atom, a methyl group, $—COOZ_1$, or $—CH_2COOZ_1$ ($Z_1$ more preferably represents a hydrogen atom or an alkyl group having from 1 to 6 carbon atoms (e.g., methyl, ethyl, propyl, butyl, and hexyl)).

Most preferably, either one of $a_1$ and $a_2$ is a hydrogen atom.

Specific examples of the polymerizable double bond group represented by formula (I) are:

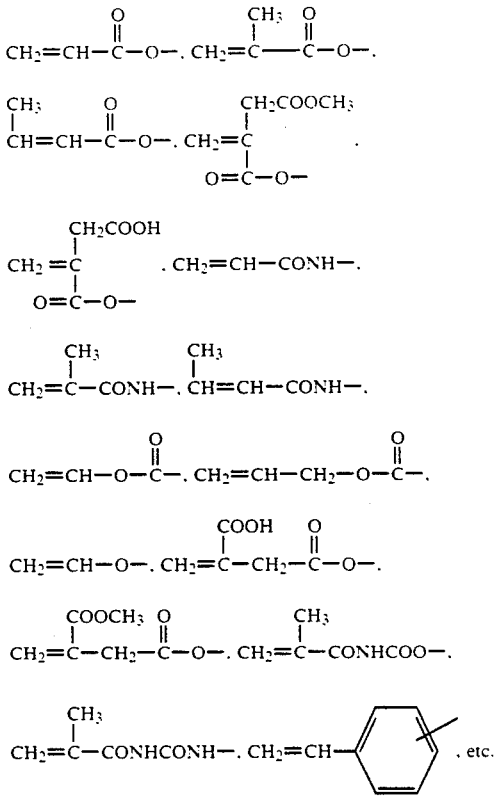

In formulae (IIa) and (IIb), $X_1$ has the same meaning as $X_0$ in formula (I). $b_1$ and $b_2$, which may be the same or different, have the same meaning as $a_1$ and $a_2$ in formula (I).

$Q_1$ represents an aliphatic group having from 1 to 18 carbon atoms or an aromatic group having from 6 to 12 carbon atoms. Examples of the aliphatic group include a substituted or unsubstituted alkyl group having from 1 to 18 carbon atoms (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl 2-(trimethoxysilyl)ethyl, 2-tetrahydrofuryl, 2-thienylethyl, 2-N,N-dimethylaminoethyl, and 2-N,N-diethylaminoethyl), a cyanoalkyl group having from 5 to 8 carbon atoms (e.g., cycloheptyl, cyclohexyl, and cyclooctyl), and a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl). Examples of the aromatic group include a substituted or unsubstituted aryl group having from 6 to 12 carbon atoms (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (IIa), $X_1$ preferably represents —COO—, —OCO—, $—CH_2COO—$, $—CH_2OCO—$, —O—, —CO—, —CONHCOO—, —CONHCONH—, —CONH—, $—SO_2NH—$ or

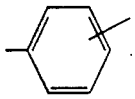

Preferred examples of $b_1$ and $b_2$ are the same as those described above for $a_1$ and $a_2$.

In formula (IIb), V represents —CN, —$CONH_2$, or

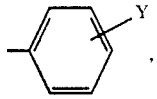

wherein Y represents a hydrogen atom, a halogen atom (e.g., chlorine and bromine), a hydrocarbon group (e.g., methyl, ethyl, propyl, butyl, chloromethyl, and phenyl), an alkoxyl group (e.g., methoxy, ethoxy, propoxy, and butoxy), or —$COOZ_2$ (wherein $Z_2$ preferably represents an alkyl group having from 1 to 8 carbon atoms, an aralkyl group having from 7 to 12 carbon atoms, or an aryl group).

Macromonomer (MA) or (MB) may contain two or more polymer components represented by formulae (IIa) and/or (IIb). Where $Q_1$ is an aliphatic group, it is preferable that the content of the aliphatic group having from 6 to 12 carbon atoms does not exceed 20% by weight based on the total polymer components in macromonomer (MA) or (MB).

Where $X_1$ in formula (IIa) is —COO—, it is preferable that the content of the polymer component of formula (IIa) is at least 30% by weight based on the total polymer components in macromonomer (MA) or (MB).

It is required for macromonomer (MA) to contain a copolymer component containing a polar group (—COOH, —$PO_3H_2$, —$SO_3H$, —OH, and

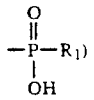

in addition to the copolymer component represented by formula (IIa) and/or (IIb).

The component containing a specific polar group in macromonomer (MA) may be any of vinyl compounds containing such a polar group and copolymerizable with the copolymer component of formula (IIa) and/or (IIb). Examples of such vinyl compounds are described, e.g., in Kobunshi Gakkai (ed.), *Kobunshi Data Handbook* (*Kiso-hen*), Baifukan (1986). Specific examples of these vinyl monomers are acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-methyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the above-described polar group in the substituents thereof.

In the polar group

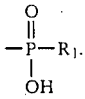

the hydrocarbon group as represented by $R_1$ or $R_2$ includes those described above for $Q_1$ in formula (IIa).

The polar group —OH includes alcohols containing a vinyl group or an allyl group (e.g., allyl alcohol), compounds containing —OH in the ester substituent or N-substituent thereof, e.g., methacrylic esters, and acrylamide), hydroxyphenol, and methacrylic acid esters or amides containing a hydroxyphenyl group as a substituent.

Specific examples of the polar group-containing vinyl monomers in macromonomer (MA) are shown below for illustrative purposes only but not for limitation. In the following formulae, a represents —H, —$CH_3$, —Cl, —Br, —CN, —$CH_2COOCH_3$, or —$CH_2COOH$; b represents —H or —$CH_3$; j represents an integer of from 2 to 18; k represents an integer of from 2 to 51 represents an integer of from 1 to 4; and m represents an integer of from 1 to 12.

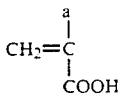

(A-1)

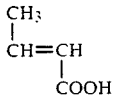

(A-2)

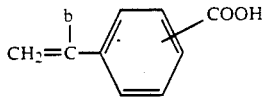

(A-3)

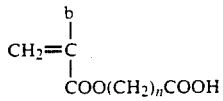

(A-4)

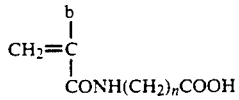

(A-5)

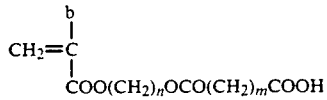

(A-6)

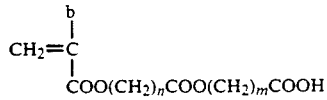

(A-7)

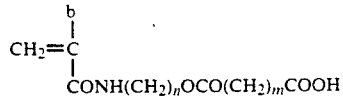

(A-8)

-continued
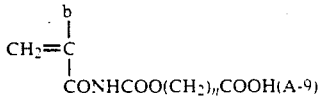
(A-9)
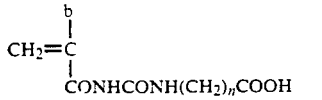
(A-10)
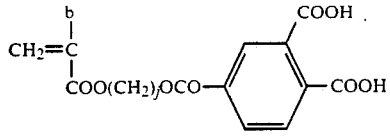
(A-11)
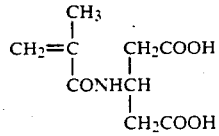
(A-12)
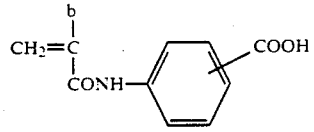
(A-13)
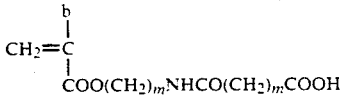
(A-14)
(A-15)
(A-16)
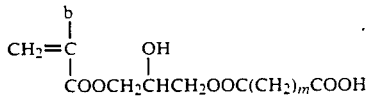
(A-17)
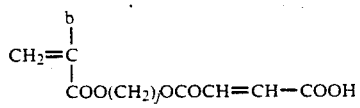
(A-18)
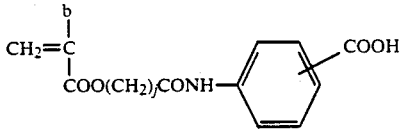
(A-19)
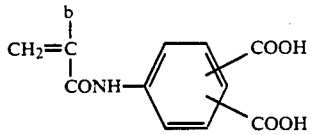
(A-20)
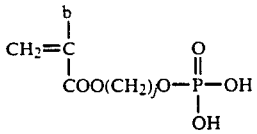
(A-21)
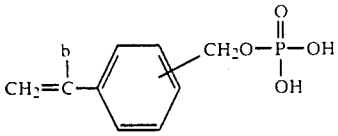
(A-22)
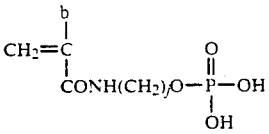
(A-23)
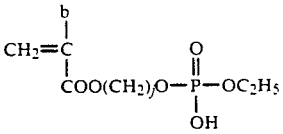
(A-24)
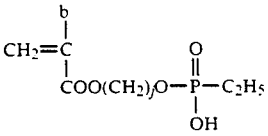
(A-25)
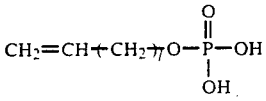
(A-26)
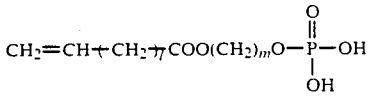
(A-27)
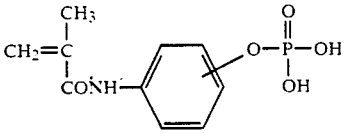
(A-28)
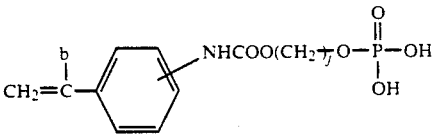
(A-29)
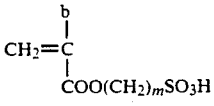
(A-30)
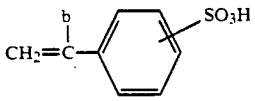
(A-31)
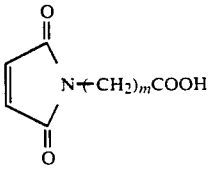
(A-32)

-continued (A-33)

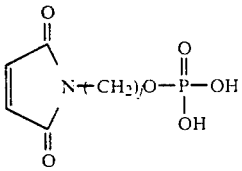

(A-34)

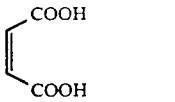

(A-35)

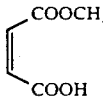

(A-36)

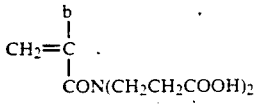

(A-37)

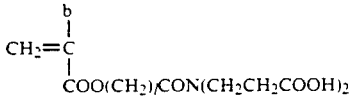

(A-38)

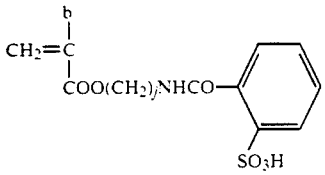

(A-39)

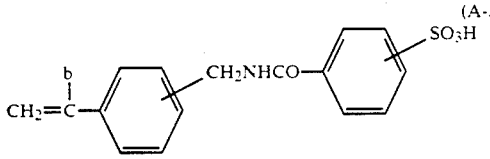

(A-40)

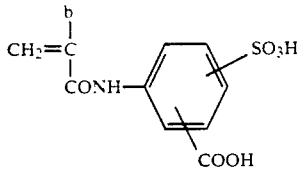

(A-41)

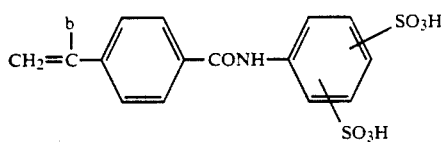

(A-42)

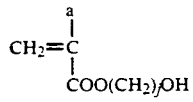

(A-43)

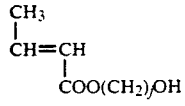

(A-44)

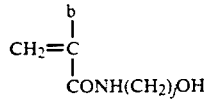

-continued (A-45)

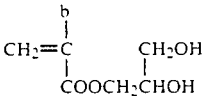

(A-46)

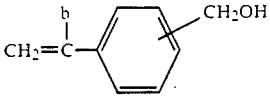

(A-47)

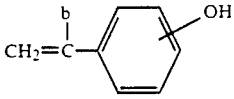

(A-48)

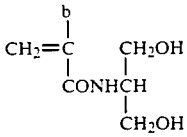

(A-49)

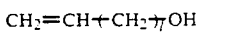

(A-50)

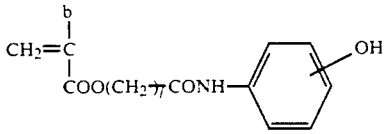

(A-51)

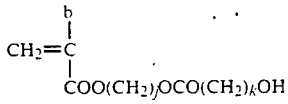

(A-52)

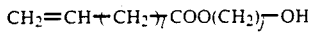

(A-53)

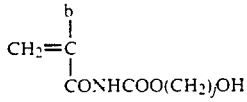

(A-54)

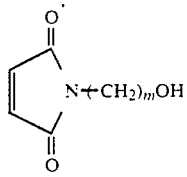

(A-55)

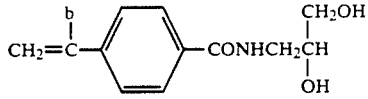

(A-56)

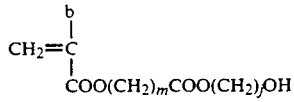

The proportion of the polar group-containing copolymer component in macromonomer (MA) ranges from 0.5 to 50 parts by weight, and preferably from 1 to 40 parts by weight, per 100 parts by weight of the total copolymer components.

When the monofunctional macromonomer comprising the polar group-containing random copolymer is copolymerized to obtain resin (A), a total content of the polar group-containing component present in the total grafted portion of resin (A preferably ranges from 0.1 to 10 parts by weight per 100 parts by weight of the total polymer components in resin (A). In particular, where resin (A) contains an acidic group selected from —COOH, —$SO_3H$, and —$PO_3H_2$, the total content of such acidic group-containing component present in the grafted portion is preferably from 0.1 to 5% by weight.

Macromonomer (MA) or (MB) in resins (A) or (B) may further contain polymer components other than the above-mentioned polymer components. Examples of monomers corresponding to other recurring units include acrylonitrile, methacrylonitrile, acrylamides, methacrylamides, styrene and derivatives thereof (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyrrolidone, vinylpyridine, vinylimidazole, vinylthiophene, vinylpyrazole, vinyldioxane, and vinyloxazine).

The proportion of these other recurring units in macromonomer (MA) or (MB) is preferably from 1 to 20 parts by weight per 100 parts by weight of the total polymer components in macromonomer (MA) or (MB).

As stated above, macromonomer (MA) or (MB) has a chemical structure in which a polymerizable double bond group represented by formula (I) is bonded to only one terminal of the main chain of the random copolymer comprising at least a recurring unit of formula (IIa) and/or (IIb) and a recurring unit containing a specific polar group in case of (MA) or only one terminal of the main chain of the polymer comprising at least a recurring unit of formula (IIa) and/or (IIb) in case of (MB) either directly or through an arbitrary linking group. The linking groups which connect the component of formula (I) to the compound of formula (IIa) or (IIb) (or the polar group-containing component) includes a carbon-carbon bond (single bond or double bond), a carbon-hetero atom bond (the hetero atom including an oxygen atom, a sulfur atom, a nitrogen atom, and a silicon atom), a hetero atom-hetero atom bond, and an arbitrary combination thereof.

Specific examples of the linking group are

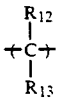

(wherein $R_{12}$ and $R_{13}$ each represents a hydrogen atom, a halogen atom (e.g., fluorine, chlorine, and bromine), a cyano group, a hydroxyl group, an alkyl group (e.g., methyl, ethyl, and propyl), etc.),

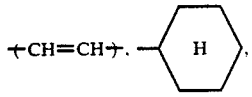

-continued

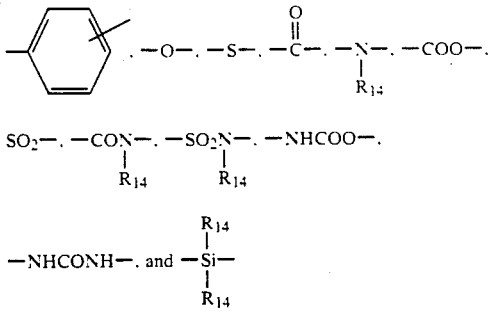

(wherein $R_{14}$ represents a hydrogen atom, a hydrocarbon group (the same as those enumerated for $Q_1$ in formula (IIa), etc.), and a combination of two or more of these linking groups.

If the weight average molecular weight of macromonomer (MA) or (MB) exceeds $2\times10^4$, copolymerizability with the monomer represented by formula (III) is reduced. If it is too small, the effect of improving electrophotographic characteristics of the photoconductive layer would be lessened and, accordingly, it is preferably not less than $1\times10^3$.

Macromonomer (MA) in resin (A) can be easily produced by known processes for example, a radical polymerization process comprising radical polymerization in the presence of a polymerization initiator and/or a chain transfer agent containing a reactive group, e.g., a carboxyl group, an acid halide group, a hydroxyl group, an amino group, a halogen atom, and an epoxy group, in the molecule thereof to obtain an oligomer terminated with the reactive group and then reacting the oligomer with various reagents to prepare a macromonomer. For details, reference can be made to P. Dreyfuss & R. P. Quirk, *Encycl. Polym. Sci. Eng.*, Vol. 7, p. 551 (1987), P. F, Rempp and E. Franta, *Adv. Polym. Sci.*, Vol. 58, p. 1 (1984), Yushi Kawakami, *Kacaku Kocyo*, Vol. 38, p. 56 (1987), Yuya Yamashita, *Kobunshi*, Vol. 31, p. 988 (1982), Shiro Kobayashi, *Kobunshi*, Vol. 30, Koichi Itoh, *Kobunshi Kako*, Vol. 35, p. 262 (1986), Shiro Toki and Takashi Tsuda, *Kino Zairyo*, Vol. 1987., No. 10, p. 5, and literatures cited therein.

However, it should be taken into consideration that macromonomer (MA) in resin (A) is produced using a polar group-containing compound as a polymer component. It is preferable, therefore, that synthesis of macromonomer (MA) be carried out according to the following procedures.

Process (I):

Radical polymerization and introduction of a terminal reactive group are effected by using a monomer having a specific polar group in the form of a protected functional group. A typical mode of these reaction is shown by the following reaction scheme:

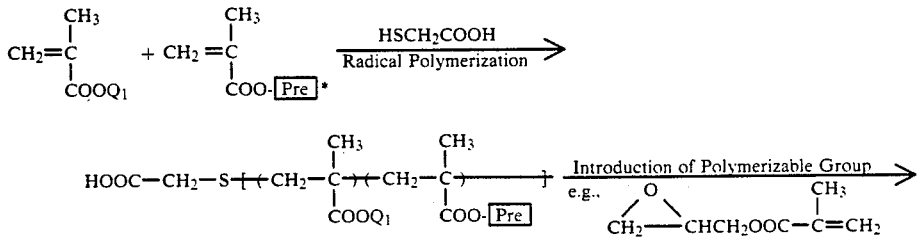

-continued

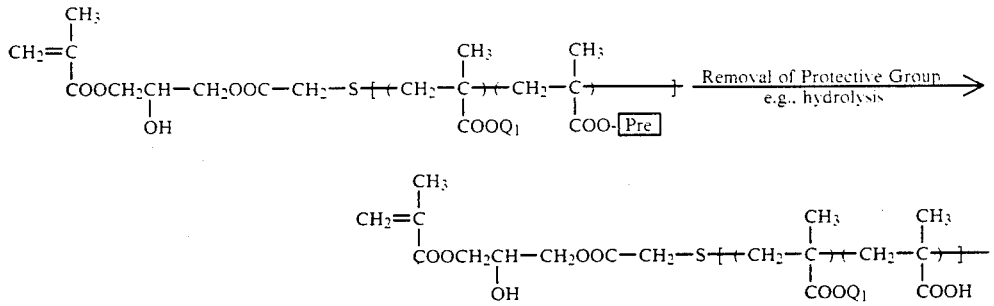

*Pre: Protective group for a carboxyl group, e.g.,

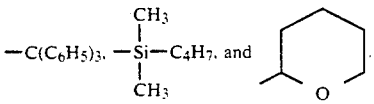

Protection of the polar group (i.e., $-SO_3H$, $-PO_3H_2$,

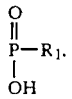

and —OH) randomly existing in macromonomer (MA) and removal of the protective group (e.g., hydrolysis, hydrogenation, and oxidative decomposition) can be carried out according to known techniques. For details, reference can be made to J. F. W. MacOmie, *Protective Groups in Organic Chemistry*, Plenum Press (1973), T. W. Greene, *Protective Groups in Organic Synthesis*, John Wiley & Sons (1981), Ryohei Oda, *Kobunshi Fine Chemical*, Kodansha (1976), Yoshio Iwakura and Keisuke Kurita, *Han-nosei Kobunshi*, Kodansha (1977), G. Berner, et al., *J. Radiation Curino*, 1986, No. 10, p. 10, JP-A-62-212669, JP-A-62-286064, JP-A-62-210475, JP-A-62-195684, JP-A-62-258476, JP-A-63-260439, JP-A-01-63977 and JP-A-01-70767.

Process (II):

Process (II) comprises synthesizing an oligomer as described above, and reacting the oligomer terminated with a specific reactive group and also containing therein a polar group with a reagent containing a polymerizable double bond group which is selectively reactive with the specific reactive group by utilizing a difference in reactivity between said specific reactive group and said polar group. A typical mode of these reaction is illustrated by the following reaction scheme:

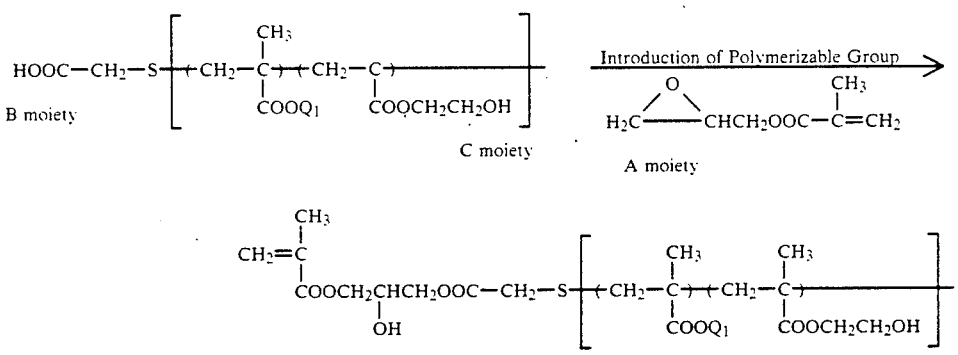

Specific examples of suitable combinations of specific functional groups shown by A, B, and C moieties in the above reaction scheme are shown in Table 1 below. It should be noted, however, that the present invention is not limited thereto. What is important in this reaction mode is that macromonomer synthesis be achieved without protecting the polar group by utilizing reaction selectivity generally observed in organic chemistry.

TABLE 1

| Functional Group in Reagent for Polymerizable Group Introduction (Moiety A) | Specific Functional Group Terminating Oligomer (Moiety B) | Polar Group in Recurring Unit Component of Oligomer (Moiety C) |
|---|---|---|
| 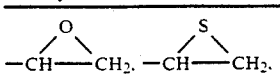 | —COOH | —OH |

TABLE 1-continued

| Functional Group in Reagent for Polymerizable Group Introduction (Moiety A) | Specific Functional Group Terminating Oligomer (Moiety B) | Polar Group in Recurring Unit Component of Oligomer (Moiety C) |
|---|---|---|
| 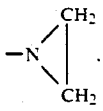 -Halogen (e.g., —Br, —I and —Cl) | $-NH_2$ | |
| —COCl, Acid anhydride, $-SO_3H$, $-SO_2Cl$ | —OH, | —COOH, |
| | $-NH_2$ | $-PO_3H_2-$, 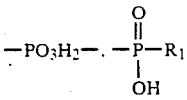 |
| —COOH, $-NHR_{15}$ ($R_{15}$: H or alkyl) | -Halogen | —COOH, $-SO_3H$, $-PO_3H_2$, —OH, 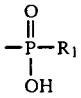 |
| —COOH, | 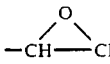 | —OH |
| $-NHR_{15}$ | 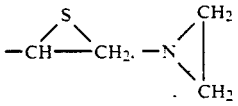 | |
| —OH, $-NHR_{15}$ | —COCl, $-SO_2Cl$ | —COOH, $-SO_3H$, $-PO_3H_2$ |

Suitable chain transfer agents which can be used in the synthesis of macromonomer (MA) include mercapto compounds containing a polar group or a substituent capable of being converted to a polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)-carbamoyl]propionic acid, 3-[N-mercaptoethyl)amino]-propionic acid, N-(3-mercaptopropionyl)alanine, 2-mercaptoethanesulfonic acid, 3-mercaptopropanesulfonic acid, 4-mercaptobutanesulfonic acid,2-mercaptoethanol,3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), or disulfide compounds (oxidation product of these mercapto compounds); and iodoalkyl compounds containing a polar group or a substituent capable of being converted to a polar group (e.g., iodoacetic acid, iodopropionic acid, 2-iodoethanol, 2-iodoethanesulfonic acid, and 3-iodopropanesulfonic acid). Preferred of them are mercapto compounds.

Examples of suitable polymerization initiators containing a specific reactive group which can be used in the synthesis of macromonomer (MA) include 2,2'-azobis(2-cyanopropanol), 2,2'-azobis(2-cyanopentanol), 4,4'-azobis(2-cyanovaleric acid), 4,4'-azobis(4-cyanovaleryl chloride), 2,2'-azobis[2-(5-methyl-2-imidazolin-2-yl)propane], 2,2'-azobis[2-(2-imidazolin-2-yl)propane], 2,2'-azobis[2-(3,4,5,6-tetrahydropyrimidin-2-yl)propane], 2,2'-azobis{2-[1-(2-hydroxyethyl)-2-imidazolin-2-yl]propane}, and 2,2'-azobis [2-methyl-N-(2-hydroxyethyl)propionamide] and derivatives of these compounds.

The chain transfer agent or polymerization initiator is used in an amount of from 0.1 to 15 parts by weight, and preferably from 0.5 to 10 parts by weight, per 100 parts by weight of the total monomers.

Specific examples of macromonomer (MA) are shown below for illustrative purposed only but not for limitation. In the following formulae, b represents —H or $-CH_3$; d represents —H, $-CH_3$, or $-CH_2COOCH_3$; R represents $-C_nH_{2n+1}$ (wherein n represents an integer of from 1 to 18), $-CH_2H_6H_5$,

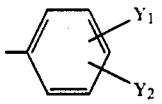

(wherein $Y_1$ and $Y_2$ each represents —H, —Cl, —Br, $-CH_3$, $-COCH_3$, or $-COOCH_3$),

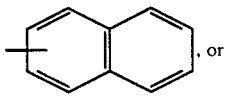

, or

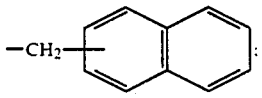

$W_1$ represents —CN, $-OCOCH_3$, $-CONH_2$, or $-C_6H_5$; $W_2$ represents —Cl, —Br, —CN, or $-OCH_3$; r represents an integer of from 2 to 18; s represents an integer of from 2 to 12; and t represents an integer of from 2 to 4.
(MA-1)
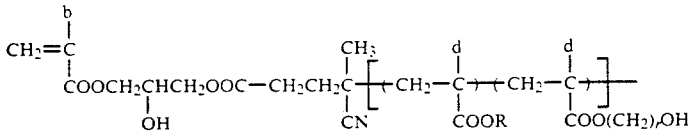
(MA-2)
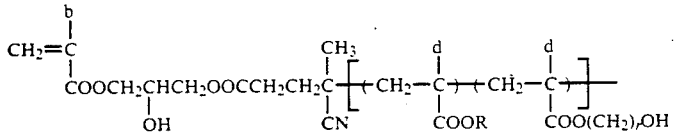
(MA-3)
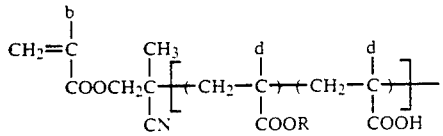
(MA-4)
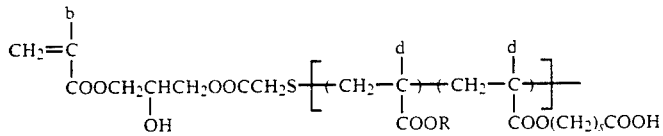
(MA-5)
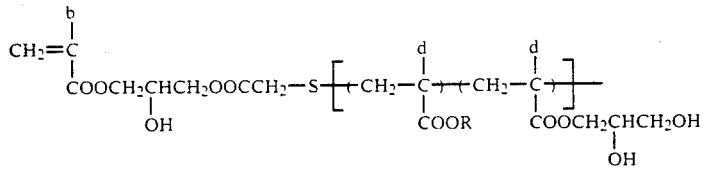
(MA-6)
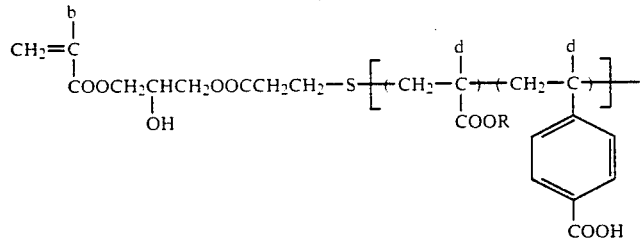
(MA-7)
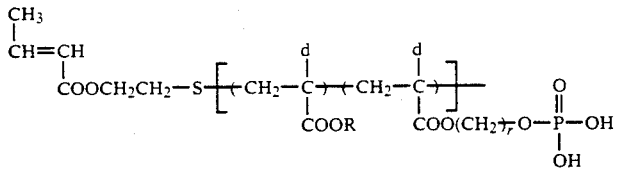
(MA-8)
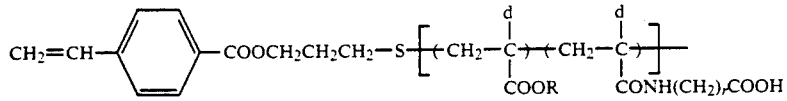
(MA-9)
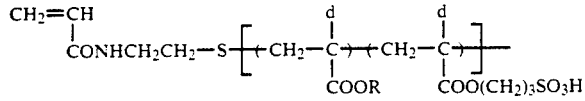

-continued
(MA-10)
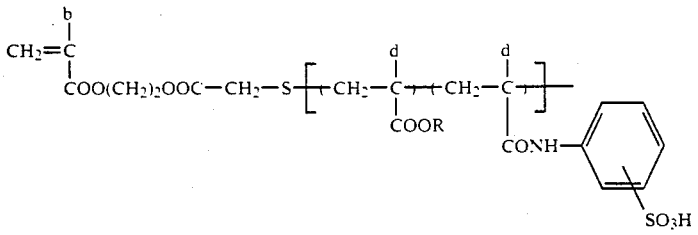
(MA-11)
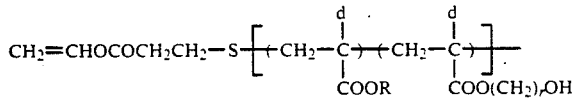
(MA-12)
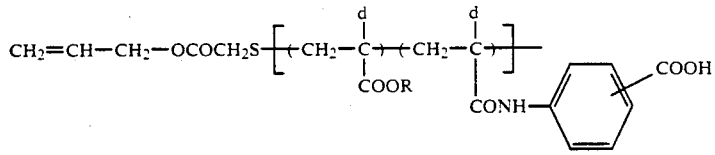
(MA-13)
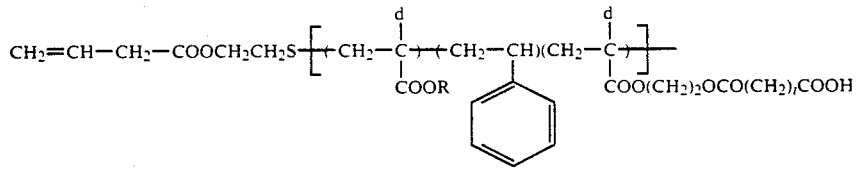
(MA-14)
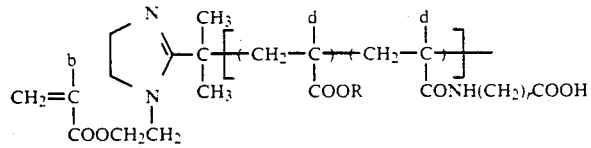
(MA-15)
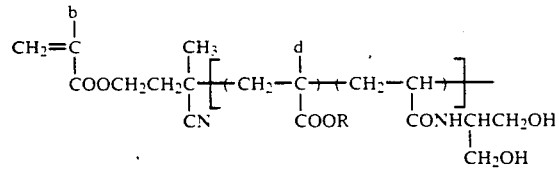
(MA-16)
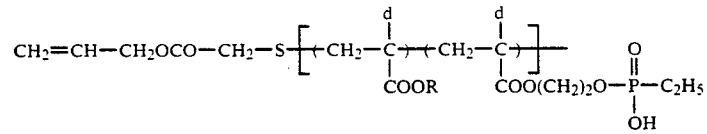
(MA-17)
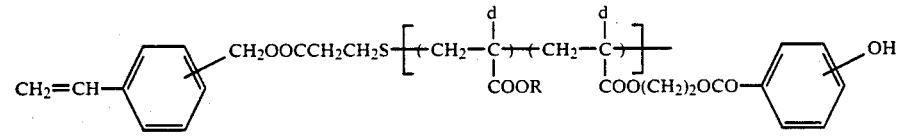
(MA-18)
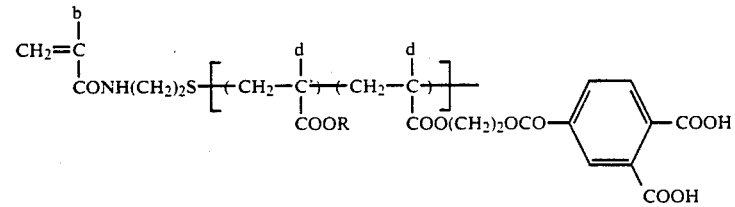

-continued (MA-19)

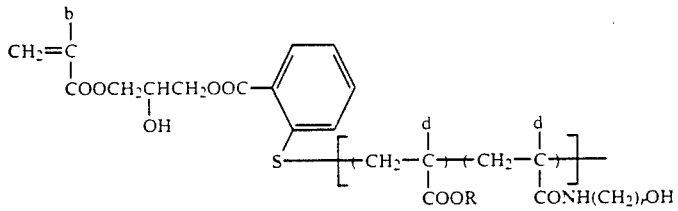

(MA-20)

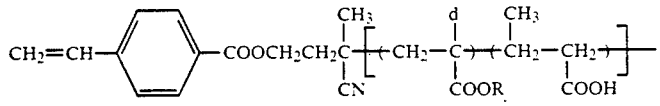

(MA-21)

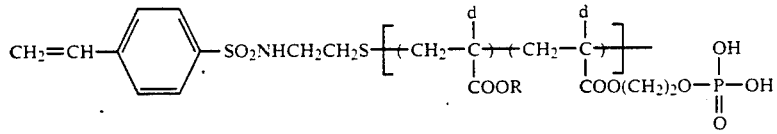

(MA-22)

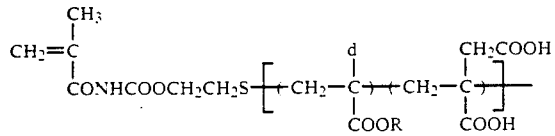

(MA-23)

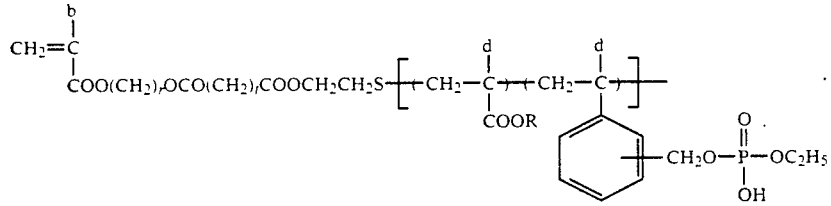

(MA-24)

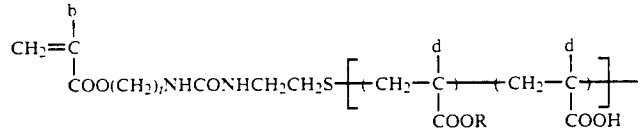

(MA-25)

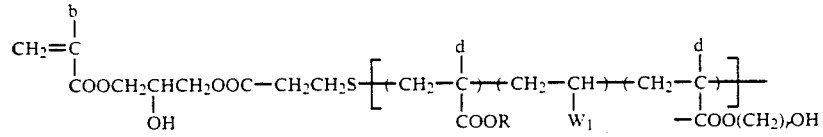

(MA-26)

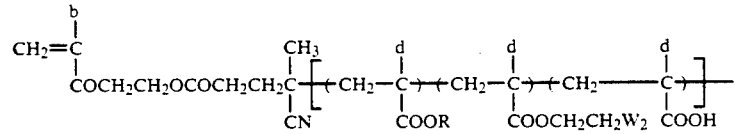

Macromonomer (MB) in resin (B) can also be synthesized by known processes, for example, a method by ion polymerization which comprises reacting various reagents onto a terminal of a living polymer obtained by anion polymerization or cation polymerization, a method by radical polymerization which comprises reacting various reagents onto a reactive group-terminated oligomer obtained by radical polymerization in the presence of a polymerization initiator and/or chain transfer agent containing a reactive group, e.g., a carboxyl group, a hydroxyl group, and an amino group, in the molecule thereof, and a method by polyaddition condensation which comprises introducing a polymerizable double bond group into an oligomer obtained by polyaddition or polycondensation in the same manner as in the above-described radical polymerization method. For details, reference can be made to P. Dreyfuss & R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Polym. Sci.*, Vol. 285, p. 95 (1984), R. Asami and M. Takari, *Makvamol. Chem. Suppl.*, Vol. 12, p. 163 (1985), P. Rempp, et al., *Makvamol. Chem. Suppl.*, Vol. 8, p. 3 (1984), Yushi Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262

(1986), Shiro Toki and Takashi Tsuda, *Kino Zairyo*, Vol. 1987, No. 10, p. 5, and literatures cited therein.

In resin (B), the proportion of macromonomer (MB) is from 1 to 80% by weight, and preferably from 5 to 60% by Specific examples of macromonomer (MB) are shown below for illustrative purposes only but not for limitation. In the following formulae, $c_1$ represents —H or —$CH_3$; $d_1$ represents —H or —$CH_3$; $d_2$ represents —H, —$CH_3$, or —$CH_2COOCH_3$; $R_{21}$ represents —$C_dH_{2d+1}$, —$CH_2C_6H_5$, —$C_6H_5$, or

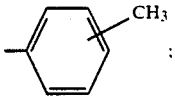

$R_{22}$ represents —$C_dH_{2d+1}$, $-(CH_2)_eC_6H_5$, or

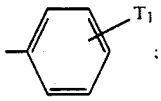

$R_{23}$ represents —$C_dH_{2d+1}$, —$CH_2C_6H_5$, or —$C_6H_5$; $R_{24}$ represents —$C_dH_{2d-1}$ or —$CH_2C_6H_5$; $R_{25}$ represents —$C_dH_{2d+1}$ —$CH_2C_6H_5$, or

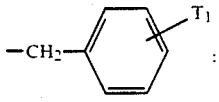

$R_{26}$ represents —$C_dH_{2d+1}$; $R_{27}$ represents —$C_dH_{2d+1}$, —$CH_2C_6H_5$, or

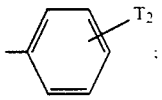

$R_{28}$ represents —$C_dH_{2d-1}$; —$CH_2C_6H_5$, or

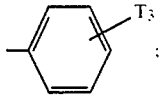

$V_1$ represents —$COOCH_3$, —$C_6H_5$, or —CN; $V_2$ represents —$OC_dH_{2d+1}$, —$OCOC_dH_{2d-1}$, —$COOCH_3$, —$C_6H_5$, or —CN; $V_3$ represents —$COOCH_3$, —$C_6H_5$,

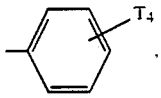

or —CN; $V_4$ represents —$OCOC_dH_{2d+1}$, —CN, —$CONH_2$, or —$C_6H_5$; $V_5$ represents —CN, —$CONH_2$, or —$C_6H_5$; $V_6$ represents —$COOCH_3$, —$C_6H_5$, or

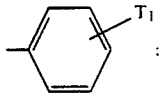

$T_1$ represents —$CH_3$, —Cl, —Br, or —$OCH_3$; $T_2$ represents —$CH_3$, —Cl, or —Br; $T_3$ represents —H, —Cl, —Br, —$CH_3$, —CN, or —$COOCH_2$; $T_4$ represents —$CH_3$, —Cl, or —Br; $T_5$ represents —Cl, —Br, —F, —OH, or —CN; $T_6$ represents —H, —$CH_3$, —Cl, —Br, —$OCH_3$, or —$COOCH_3$; d represents an integer of from 1 to 18; e represents an integer of from 1 to 3; and f represents an integer of from 2 to 4.

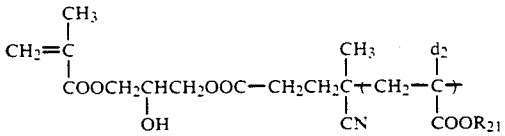

(MB-1)

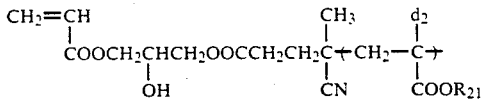

(MB-2)

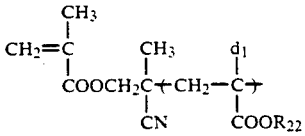

(MB-3)

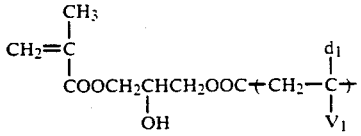

(MB-4)

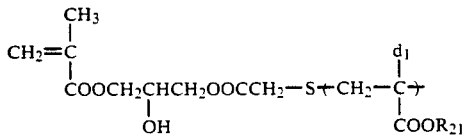

(MB-5)

-continued
(MB-6)
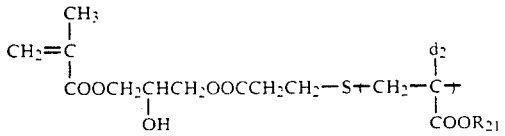
(MB-7)
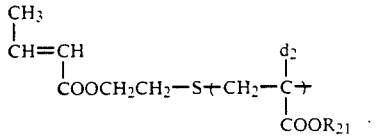
(MB-8)
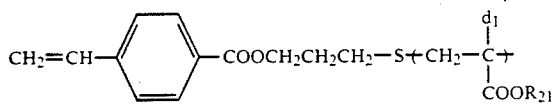
(MB-9)
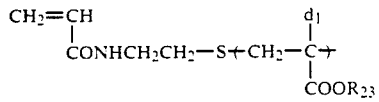
(MB-10)
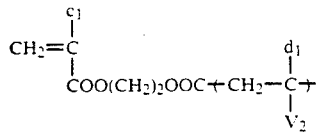
(MB-11)
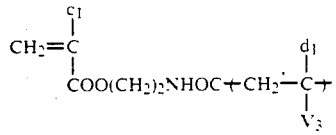
(MB-12)
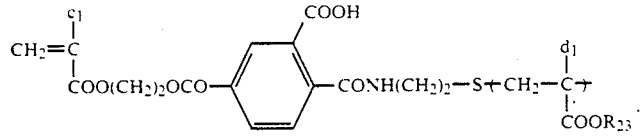
(MB-13)
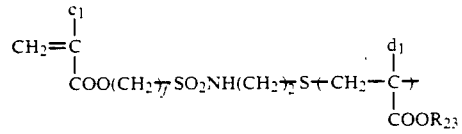
(MB-14)
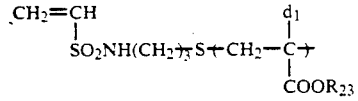
(MB-15)
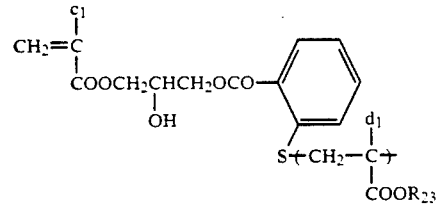
(MB-16)
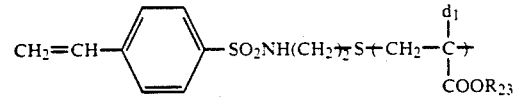

-continued
(MB-17)
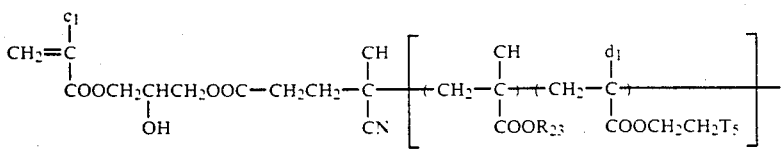
(MB-18)
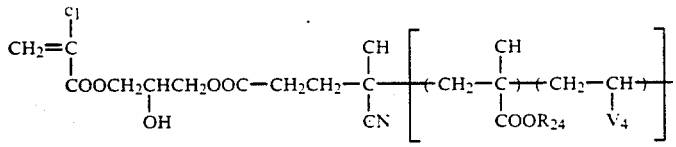
(MB-19)
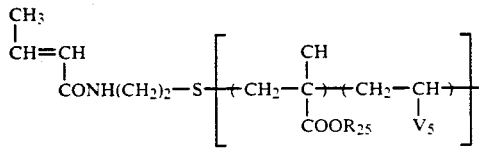
(MB-20)
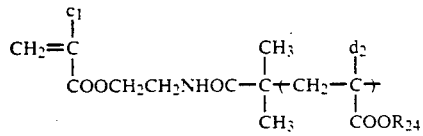
(MB-21)
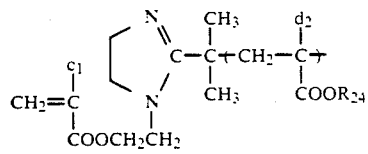
(MB-22)
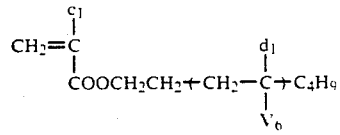
(MB-23)
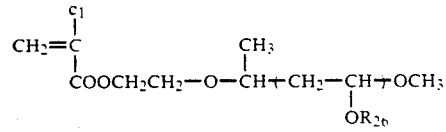
(MB-24)
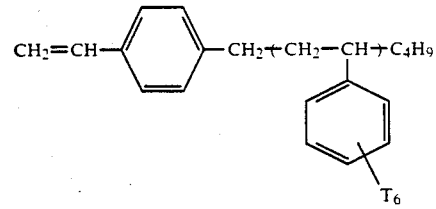
(MB-25)
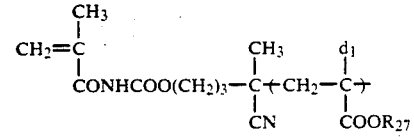
(MB-26)
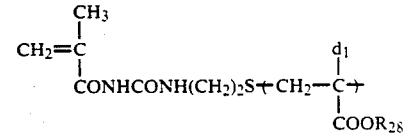
In the monomer of formula (III) which is copolymerized with macromonomer (MA) or (MB), $c_1$ and $c_2$, which may be the same or different, have the same meaning as $a_1$ and $a_2$ in formula (I); $X_2$ has the same meaning as $X_1$ in formula (IIa); and $Q_2$ has the same meaning as $Q_1$ in formula (IIa).

Resins (A) and (B) which can be used in the binder of the present invention may further contain other copolymer components in addition to macromonomer (MA) or (MB) and the monomer of formula (III). Examples of such other copolymer components include α-olefins, acrylonitrile, methacrylonitrile, acrylamides, methacrylamides, styrenes, vinyl-containing naphthalene compounds (e.g., vinylnaphthalene and 1-isopropenylnaphthalene), and vinyl-containing heterocyclic compounds (e.g., vinylpyrrolidone, vinylpyridine, vinylthiophene, vinyltetrahydrofuran, vinyl-1,3-dioxoran, vinylimidazole, vinylthiazole, and vinyloxazine).

The proportion of these monomers other than macromonomer (MA) or (MB) and the monomer of formula (III) in the copolymer should not exceed 20% by weight.

Resin (B) may furthermore contain a vinyl compound having an acidic group. Examples of such vinyl compounds are described, e.g., in Kobunshi Gakkai (ed.), *Kobunshi Data Handbook (Kiso-hen)*, Baifukan (1986). Specific examples of these vinyl monomers are acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-methyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing an acidic group in the substituents thereof.

It is preferable that the proportion of the acidic group-containing vinyl compound as a recurring unit of resin (B) does not exceed 10% by weight of the total copolymer components. If the content of the acidic group-containing vinyl compound exceeds 10% by weight, the interaction with inorganic photoconductive particles becomes excessive to impair surface smoothness of the light-sensitive material, resulting in deterioration of electrophotographic characteristics, particularly charging properties and dark charge retention.

Resin (B) preferably has a weight average molecular weight of at least $3\times10^4$.

Resin (A) may contain at least one polar group selected from the group consisting of $-PO_3H_2$, $-SO_3H$, —COOH, —OH, and

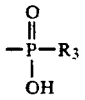

at one terminal of the polymer main chain comprising at least one macromonomer (MA) and at least one monomer of formula (III) (i.e., resin (A')). Further, resin (A) having no such polar group and resin (A') having the polar group may be used in combination.

The polar groups, —OH and

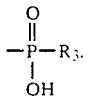

which may be bonded to one terminal of the polymer main chain have the same meaning as the polar groups, —OH and

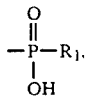

present in the polar group-containing polymer component of resin (A).

According to a preferred embodiment of the present invention, resin (B) is a copolymer containing at least one acidic group selected from the group consisting of $-PO_3H_2$, $-SO_3H$, —COOH, —OH, —SH, $-PO_3R_5H$ bonded to one terminal of a polymer main chain comprising at least one recurring unit of formula (III) and at least one macromonomer (MB) (resin (B')). In the acidic group $-PO_3R_5H$, $R_5$ represents a hydrocarbon group. Specific examples of the hydrocarbon group as $R_5$ are the same as those mentioned with respect to $R_1$.

It is preferable for resin (B') with the acidic group being bonded to one terminal of the main chain thereof to contain no copolymer component containing a polar group, such as a carboxyl group, a sulfo group, a hydroxyl group, and a phosphono group in the polymer main chain thereof.

In resins (A') and (B'), the polar group is bonded to one terminal of the polymer main chain either directly or via an arbitrary linking group.

The linking group includes a carbon-carbon bond (single bond or double bond), a carbon-hetero atom bond (the hetero atom including an oxygen atom, a sulfur atom, a nitrogen atom, and a silicon atom), a hetero atom-hetero atom bond, or an arbitrary combination thereof. Specific examples of the linking group are

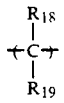

(wherein $R_{18}$ and $R_{19}$ have the same meaning as $R_{12}$ and $R_{13}$),

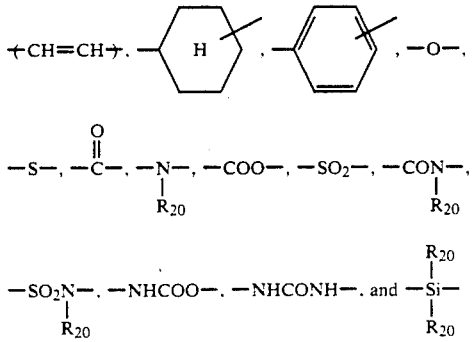

(wherein $R_{20}$ has the same meaning as $R_{14}$), and a combination of two or more of these linking groups.

Resin (A') having a specific polar group at the terminal of the polymer main chain can be synthesized by a method in which at least macromonomer (MA) and the monomer of formula (III) are copolymerized in the presence of a polymerization initiator or a chain transfer agent containing in the molecule thereof the specific polar group or a functional group capable of being converted to the polar group. More specifically, resin (A') can be synthesized according to the method described above for the synthesis of macromonomer (MA) in which a reactive group-terminated oligomer is used.

In resin (B'), the proportion of the acidic group bonded to one terminal of the polymer main chain preferably ranges from 0.1 to 15% by weight, and more preferably from 0.5 to 10% by weight, per 100 parts by weight of resin (B'). If it is less than 0.1% by weight, the effect of improving film strength is small. If it exceeds 15% by weight, photoconductive particles cannot be dispersed uniformly in the resin binder to cause agglomeration of the particles, failing to form a uniform coating film.

Resin (B') having a specific acidic group bonded to only one terminal of the polymer main chain thereof can be easily synthesized by a method comprising reacting various reagents on the terminal of a living polymer obtained by conventional anion polymerization or cation polymerization (ion polymerization method), a method comprising radical polymerization using a polymerization initiator and/or chain transfer agent containing a specific acidic group in the molecule (radical polymerization method), or a method comprising once preparing a polymer terminated with a reactive group by the aforesaid ion polymerization method or radical polymerization method and converting the terminal reactive group into a specific polar group by a high polymer reaction For the detail, reference can be made to P. Dreyfuss and R. P. Quirk *Encycl. Polym. Sci. Eng.*, Vol. 7, p. 551 (1987), Yoshiki Nakajo and Yuya Yamashita, *Senryo to Yakuhin*, Vol. 30, p. 232 (1985), and Akira Ueda and Susumu Nagai, *Kagaku to Kogyo*, Vol. 60, p. 57 (1986), and literatures cited therein.

The binder resin according to the present invention may contain two or more kinds of resin (A), inclusive of resin (A'), and two or more kinds of resin (B), inclusive of resin (B').

The ratio of resin (A) [inclusive of resin (A')] to resin (B) [inclusive of resin (B')] varies depending on the kind, particle size, and surface conditions of the inorganic photoconductive particles used. In general, the weight ratio of resin (A) to resin (B) is 5 to 80:95 to 20, and preferably 10 to 60:90 to 40.

The inorganic photoconductive material which can be used in the present invention includes zinc oxide, titanium oxide, zinc sulfide, cadmium sulfide, cadmium carbonate, zinc selenide, cadmium selenide, tellurium selenide, and lead sulfide.

The binder resin is used in a total amount of from 10 to 100 parts by weight, and preferably from 15 to 50 parts by weight, per 100 parts by weight of the inorganic photoconductive material.

If desired, the photoconductive layer according to the present invention may contain various spectral sensitizers. Examples of suitable spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), phthalocyanine dyes (inclusive of metallized dyes), and the like as described in Harumi Miyamoto and Hidehiko Takei, *Imaging*, Vol. 1973, No. 8, p. 12, C. J. Young, et al., *RCA Review*, Vol. 15, p. 469 (1954), Kohei Kiyota, et al., *Journal of Electric Communication Society of Japan*, J63-C, No. 2, p. 97 (1980), Yuji Harasaki, et al., *Kogyo Kacaku Zasshi*, Vol. 66, pp. 78 and 188 (1963), and Tadaaki Tani, *Journal of the Society of Photographic Science and Technology of Japan*, Vol. 35, p. 208 (1972).

Specific examples of suitable carbonium dyes, triphenylmethane dyes, xanthene dyes, and phthalein dyes are described in JP-B-51-452, JP-A-50-90334, JP-A-50-114227, JP-A-53-39130, JP-A-53-82353, U.S. Pat. Nos. 3052,540 and 4,054,450, and JP-A-57-16456.

Suitable polymethine dyes, such as oxonol dyes, merocyanine dyes, cyanine dyes, and rhodacyanine dyes, include those described in F. M. Harmmer, *The Cyanine Dyes and Related Compounds*. Specific examples are described in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

In addition, polymethine dyes for spectral sensitization in the longer wavelength region of 700 nm or more, i.e., from the near infrared region to the infrared region, include those described in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, pp. 117–118 (1982).

The light-sensitive material of the present invention is also superior in that the performance properties tend not to vary even when combined with various kinds of sensitizing dyes.

If desired, the photoconductive layer may further contain various additives commonly employed in an electrophotographic photoconductive layer, such as chemical sensitizers. Examples of such additives include electron-accepting compounds (e.g., halogen, benzoquinone, chloranil, acid anhydrides, and organic carboxylic acids) described in *Imaging*, Vol. 1973, No. 8, p. 12 supra; and polyarylalkane compounds, hindered phenol compounds, and p-phenylenediamine compounds described in Hiroshi Komon, et al., *Saikin-no Kododen Zairyo to Kankotai no Kaihatsu Jitsuyoka*, Chs. 4–6, Nippon Kagaku Joho K. K. (1986).

The amount of these additives is not particularly critical and usually ranges from 0.0001 to 2.0 parts by weight per 100 parts by weight of the photoconductive particles.

The photoconductive layer of the light-sensitive material suitably has a thickness of from 1 to 100 μm, particularly from 10 to 50 μm.

Where the photoconductive layer functions as a charge generating layer in a laminated type light-sensitive material comprising a charge generating layer and a charge transport layer, the thickness of the charge generating layer suitably ranges from 0.01 to 1 μm, particularly from 0.05 to 0.5 μm.

If desired, the light-sensitive material may have an insulating layer for the main purposes of protection of the light-sensitive material or improvement of durability and dark decay characteristics. This being the case, the insulating layer has a relatively small thickness. Where an insulating layer is provided in a light-sensitive material suited for specific electrophotographic process, it has a relatively large thickness.

Charge transporting materials useful in the above-described laminated type light-sensitive material include polyvinylcarbazole, oxazole dyes, pyrazoline dyes, and triphenylmethane dyes. The thickness of the charge transport layer ranges from 5 to 40 μm, and preferably from 10 to 30 μm.

Resins which can be used in the above-described insulating layer or charge transport layer typically include thermoplastic and thermosetting resins, e.g., polystyrene resins, polyester resins, cellulose resins, polyether resins, vinyl chloride resins, vinyl acetate resins, vinyl chloridevinyl acetate copolymer resins, polyacrylate resins, polyolefin resins, urethane resins, epoxy resins, melamine resins, and silicone resins.

The photoconductive layer according to the present invention can be formed on any known support. In general, a support for an electrophotographic light-sensitive material is preferably electrically conductive. Any of conventionally employed conductive supports may be utilized in this invention. Examples of usable conductive supports include a base, e.g., a metal sheet, paper, and a synthetic resin sheet, having been rendered electrically conductive by, for example, impregnation with a low resistant substance; the above-described base with the back side thereof (opposite to the photoconductive layer) being rendered conductive and having further coated thereon at least one layer for the purpose of prevention of curling; the above-described supports having thereon a water-resistant adhesive layer; the above-described supports having thereon at least one precoat layer; and paper laminated with a synthetic resin film on which aluminum, etc. is deposited.

Specific examples of conductive supports and materials for imparting conductivity are described in Yukio Sakamoto, *Denshishashin*, Vol. 14, No. 1, pp. 2-11 (1975), Hiroyuki Moriga, *Nyumon Tokushushi no Kagaku*, Kobunshi Kankokai (1975), and M. F. Hoover, *J. Macromol. Sci. Chem.*, A-4(6), pp. 1327-1417 (1970).

The present invention will now be illustrated in greater detail by way of Synthesis Examples, Examples, and Comparative Examples, but it should be understood that the present invention is not deemed to be limited thereto Unless otherwise indicated herein, all parts, percents, ratios and the like are by weight.

SYNTHESIS EXAMPLE 1 OF MACROMONOMER (MA)

Synthesis of Macromonomer MM-1

A mixture of 90 g of ethyl methacrylate, 10 g of 2-hydroxyethyl methacrylate, 5 g of thioglycolic acid, and 200 g of toluene was heated to 75° C. with stirring in a nitrogen stream. To the mixture was added 1.0 g of 2,2,-azobisisobutyronitrile (hereinafter abbreviated as AIBN) to conduct a reaction for 8 hours. To the mixture were added 8 g of glycidyl methacrylate, 1.0 g of N,N-dimethyldodecylamine, and 0.5 g of t-butylhydroquinone, followed by stirring at 100° C. for 12 hours. After cooling, the reaction solution was reprecipitated in 2 l of n-hexane to obtain 82 g of macromonomer (MM-1) having an average molecular weight of $3.8\times10^3$ as a white powder. (MM-1):

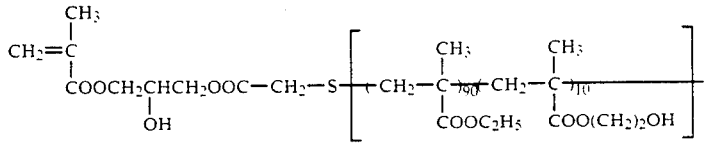

SYNTHESIS EXAMPLE 2 OF MACROMONOMER (MA)

Synthesis of Macromonomer MM-2

A mixture of 90 g of butyl methacrylate, 10 g of methacrylic acid, 4 g of 2-mercaptoethanol, and 200 g of tetrahydrofuran was heated to 70° C. in a nitrogen stream. To the mixture was added 1.2 g of AIBN to conduct a reaction for 8 hours.

After cooling in a water bath to 20° C., 10.2 g of triethylamine was added to the reaction mixture, and then 14.5 g of methacryl chloride was added dropwise thereto at a temperature of 25° C. or less with stirring. After the addition, the stirring was further continued for 1 hour. Thereafter, 0.5 g of t-butylhydroquinone was added to the reaction mixture, and the mixture was stirred for 4 hours at a temperature elevated to 60° C. After cooling, the reaction mixture was added dropwise to 1 l of water over a period of about 10 minutes, followed by stirring for 1 hour. After allowing the mixture to stand, the aqueous phase was removed by decantation. The solid thus collected was washed with water twice, dissolved in 100 ml of tetrahydrofuran, and then reprecipitated in 2 l of petroleum ether. The precipitate thus formed was collected by decantation and dried under reduced pressure to obtain 65 g of macromonomer (MM-2) having a weight average molecular weight of $5.6\times10^3$ as a viscous substance. (MM-2):

(MM-2):

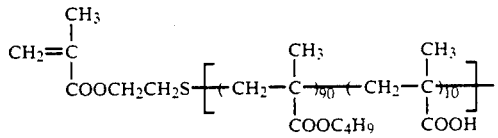

SYNTHESIS EXAMPLE 3 OF MACROMONOMER (MA)

Synthesis of Macromonomer MM-3

A mixture of 95 g of benzyl methacrylate, 5 g of 2-phosphonoethyl methacrylate, 4 g of 2-aminoethylmercaptan, and 200 g of tetrahydrofuran was heated to 70° C. with stirring in a nitrogen stream.

To the mixture was added 1.5 g of AIBN to conduct a reaction for 5 hours. Then, 0.5 g of AIBN was further added thereto, followed by reacting for 4 hours. The reaction mixture was cooled to 20° C., and 10 g of acrylic anhydride was added thereto, followed by stirring at 20° to 25° C. for 1 hour. Then, 1.0 g of t-butylhydroquinone was added thereto, followed by stirring at 50 to 60° C. for 4 hours. After cooling, the reaction mixture was added dropwise to 1 l of water while stirring over a period of about 10 minutes. After the stirring was further continued for an additional period of 1 hour, the mixture was allowed to stand, and the aqueous phase was removed by decantation. Washing with water was further repeated twice. The solid was dissolved in 100 ml of tetrahydrofuran, and the solution was re-precipitated in 2 l of petroleum ether. The precipitate was collected by decantation and dried under reduced pressure to obtain 70 g of macromonomer MM-3 having a weight average molecular weight of $7.4\times10^3$ as a viscous substance. (MM-3):

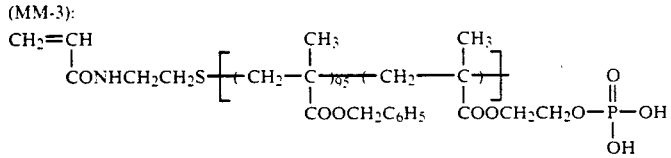

SYNTHESIS EXAMPLE 4 OF MACROMONOMER (MA)

Synthesis of Macromonomer MM-4

A mixture of 90 g of 2-chlorophenyl methacrylate, 10 g of monomer (A) shown below, 4 g of thioglycolic acid, and 200 g of tetrahydrofuran was heated to 70° C. in a nitrogen stream. To the mixture was added 1.5 g of AIBN to conduct a reaction for 5 hours. Then, 0.5 g of AIBN was further added thereto, followed by reacting for 4 hours. To the reaction mixture were added 12.4 g of glycidyl methacrylate, 1.0 g of N,N-dimethyldodecylamine, and 1.5 g of t-butylhydroquinone, and the mixture was allowed to react at 110° C. for 8 hours. After cooling, the reaction mixture was added to 100 ml of a 90 vol % tetrahydrofuran aqueous solution containing 3 g of p-toluenesulfonic acid, followed by stirring at 30° to 35° C. for 1 hours. The mixture was precipitated in 2 l of a mixed solvent of water/ethanol (⅓ by volume), and the precipitate was collected by decantation. The precipitate was dissolved in 200 ml of tetrahydrofuran, and the solution was reprecipitated in 2 l of n-hexane to obtain 58 g of macromonomer MM-4 having a weight average molecular weight of $7.6\times10^3$ as a powder. Monomer (A):

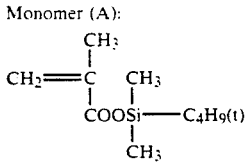

(MM-4):

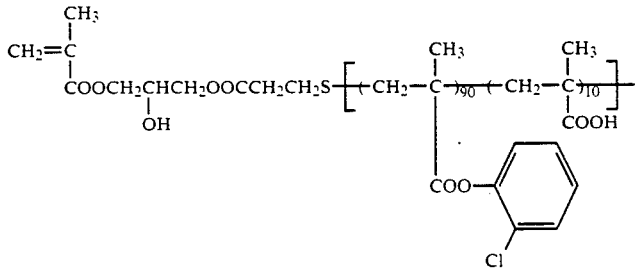

SYNTHESIS EXAMPLE 5 OF MACROMONOMER (MA)

Synthesis of Macromonomer MM-5

A mixture of 95 of 2,6-dichlorophenyl methacrylate, 5 g of 3-(2'-nitrobenzyloxysulfonyl)propyl methacrylate, 150 g of toluene, and 50 g of isopropyl alcohol was heated to 80° C. in a nitrogen stream. To the mixture was added 5.0 g of 2,2'-azobis(2-cyanovaleric acid) (hereinafter abbreviated as ACV) to conduct a reaction for 5 hours, and then, 1.0 g of ACV was added thereto, followed by reaction for 4 hours. After cooling, the reaction mixture was precipitated in 2 l of methanol, and the powder precipitated was collected by filtration and dried under reduced pressure.

A mixture of 50 g of the powder, 14 g of glycidyl methacrylate, 0.6 g of N,N-dimethyldodecylamine, 1.0 g of t-butylhydroquinone, and 100 g of toluene was stirred at 110° C. for 10 hours. After cooling to room temperature, the mixture was irradiated with light emitted from a high-pressure mercury lamp (80 W) for 1 hour under stirring. The reaction mixture was precipitated in 1 l of methanol, and the powder thus precipitated was collected by filtration and dried under reduced pressure to obtain 34 g of macromonomer MM-5 having a weight average molecular weight of $7.3\times10^3$. (MM-5):

(MM-5):

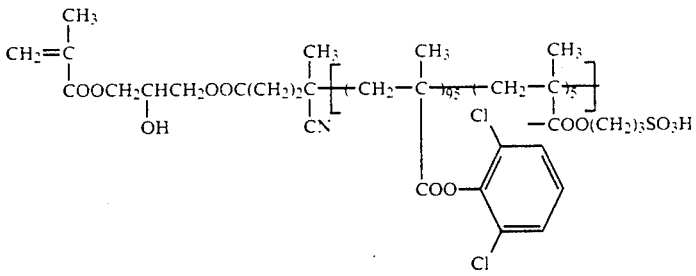

SYNTHESIS EXAMPLE 1 OF RESIN (A)

Synthesis of Resin A-1

A mixture of 65 g of benzyl methacrylate, 20 g of MM-2 obtained in Synthesis Example 2 of Macromonomer (MA), and 100 g of toluene was heated to 100° in a nitrogen stream. To the mixture was added 6 g of AIBN to conduct a reaction for 4 hours, and 3 g of AIBN was further added thereto to conduct a reaction for 3 hours to obtain a copolymer (A-4) having a weight average molecular weight of $8.6\times10^3$.

(A-2):

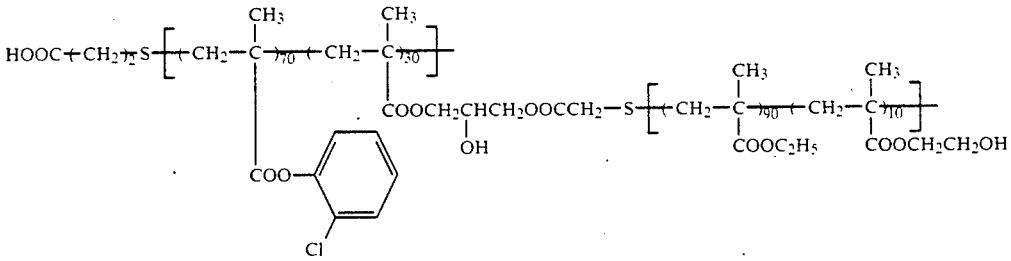

SYNTHESIS EXAMPLE 2 OF RESIN (A)

Synthesis of Resin A-2

A mixture of 70 g of 2- chlorophenyl methacrylate, 30 g of MM-1 prepared in Synthesis Example 1 of Macromonomer (MA), 3.0 g of β-mercaptopropionic acid, and 150 g of toluene was heated to 80° C. in a nitrogen stream. To the mixture was added 1.0 g of AIBN to conduct a reaction for 4 hours. To the mixture was further added 0.5 g of AIBN to conduct a reaction for 2 hours, and then 0.3 g of AIBN was furthermore added thereto, followed by reacting for 3 hours to obtain a copolymer (A-2) having a weight average molecular weight of $8.5\times10^3$.

(A-1):

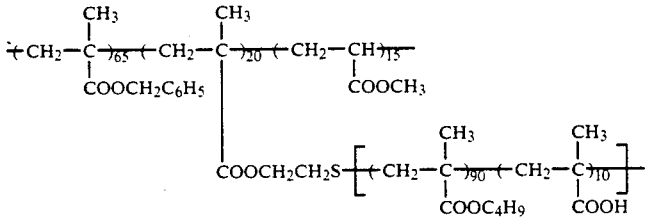

SYNTHESIS EXAMPLE 3 OF RESIN (A)

Synthesis of Resin A-3

A mixture of 60 g of 2- chloro-6-methylphenyl methacrylate, 25 g of MM-4 prepared in Synthesis Example 4 of Macromonomer (MA), 15 g of methyl acrylate, 100 g of toluene, and 50 g of isopropyl alcohol was heated to 80° C. in a nitrogen stream. To the mixture was added 5.0 g of ACV, followed by reacting for 5 hours. To the mixture was further added 1 g of ACV, followed by reacting for 4 hours to obtain a copolymer (A-3) having a weight average molecular weight of $8.5\times10^3$.

(A-3):

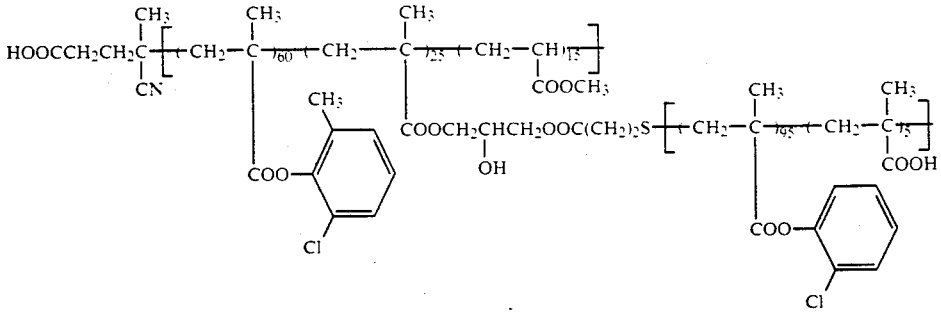

SYNTHESIS EXAMPLES 4 to 13 OF RESIN (A)

Synthesis of Resins A-4 to A-13

Resins (A) shown in Table 2 below were prepared in the same manner as in Synthesis Example 1 of Resin (A). The resulting resins had a weight average molecular weight of rom $6.0\times10^3$ to $9\times10^3$.

TABLE 2

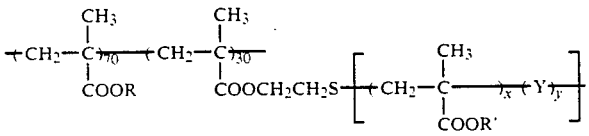

| Synthesis Example No. | Resin (A) | R | R' | x/y (by weight) | —Y— |
|---|---|---|---|---|---|
| 4 | A-4 | $-C_2H_5$ | 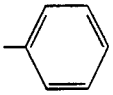 | 90/10 | $-CH_2-CH(COOH)-$ |
| 5 | A-5 | $-C_3H-$ | 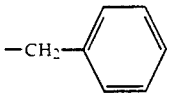 | 85/15 | $-CH_2-C(CH_3)(COO(CH_2)_2OCO(CH_2)_3COOH)-$ |
| 6 | A-6 | $-C_4H_9$ | 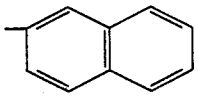 | 90/10 | $-CH_2-C(CH_3)(COO(CH_2)_2O-P(=O)(OH)-OH)-$ |
| 7 | A-7 | 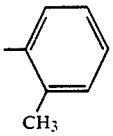 | $-CH_3$ | 90/10 | $-CH_2-CH(COOCH_2CH_2COOH)-$ |
| 8 | A-8 | 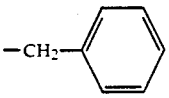 | $-C_2H_5$ | 90/10 | 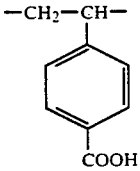 |
| 9 | A-9 | 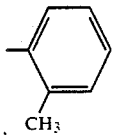 | $-C_4H_9$ | 92/8 | $-CH_2-C(CH_3)(COO(CH_2)_3SO_3H)-$ |

TABLE 2-continued

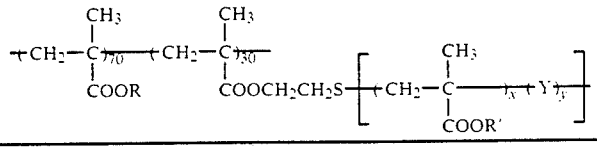

| | | | | | |
|---|---|---|---|---|---|
| 10 | A-10 | $-CH_3$ | 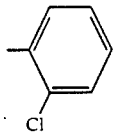 | 93/7 | 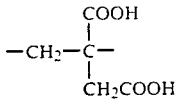 |
| 11 | A-11 | $-CH_3$ | $-C_2H_5$ | 90/10 | 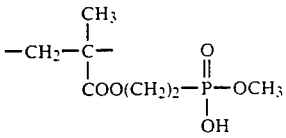 |
| 12 | A-12 | 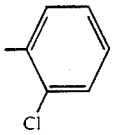 | $-C_2H_5$ | 95/5 | 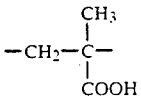 |
| 13 | A-13 | 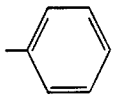 | 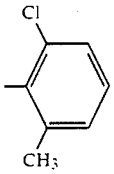 | 90/10 | 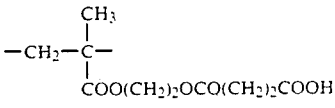 |

SYNTHESIS EXAMPLES 14 TO 27 OF RESIN (A)

Synthesis of Resins A-14 to A-27

Resins (A) shown in Table 3 below were prepared in the same manner as in Synthesis Example 2 of Resin (A). The resulting resins (A) had a weight average molecular weight (Mw) of from $5.0\times10^3$ to $9\times10^3$.

TABLE 3

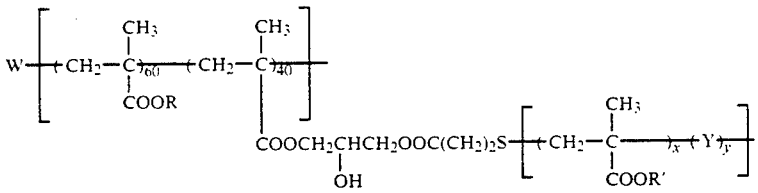

| Resin (A) | W— | R | R' | x/y (by weight) | —Y— |
|---|---|---|---|---|---|
| A-14 | HOOC—$H_2C$—S— | 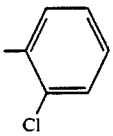 | $-C_2H_5$ | 90/10 | 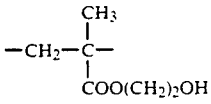 |
| A-15 | HOOC—$CH_2$<br>HOOC—CHS— | 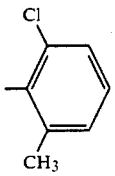 | 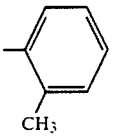 | 85/15 | 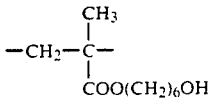 |

TABLE 3-continued
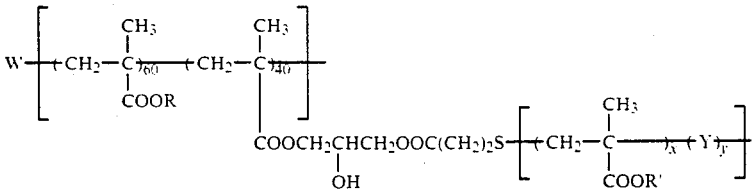
| Res-in (A) | W— | R | R' | x/y (by weight) | —Y— |
|---|---|---|---|---|---|
| A-16 | 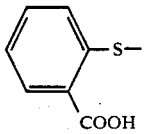 | 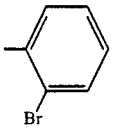 | 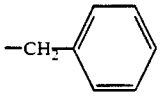 | 90/10 | 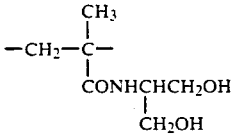 |
| A-17 | 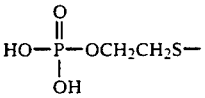 | $-C_2H_5$ | 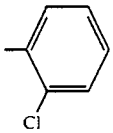 | 92/8 | 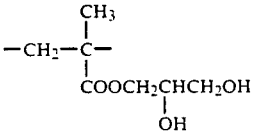 |
| A-18 | $HO_3SCH_2CH_2S-$ | 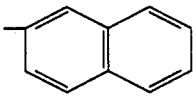 | $-C_4H_9$ | 93/7 | 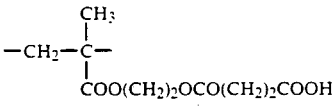 |
| A-19 | $HOCH_2CH_2-S-$ | 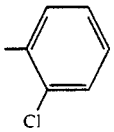 | $-C_2H_5$ | 92/8 | 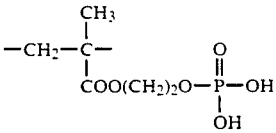 |
| A-20 | $HOOC-(CH_2)_2S-$ | 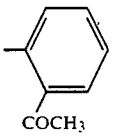 | $-C_3H_7$ | 95/5 | 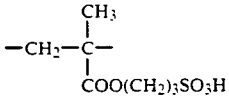 |
| A-21 | 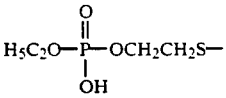 | 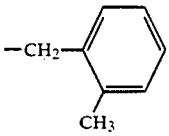 | 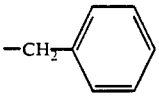 | 80/20 | 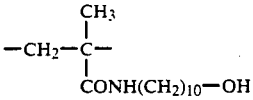 |
| A-22 | $HOOC(CH_2)_2S-$ | 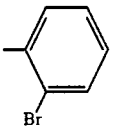 | $-C_2H_5$ | 90/10 | 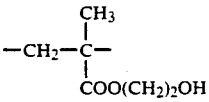 |
| A-23 | 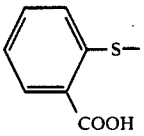 | 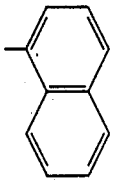 | $-C_3H_7$ | 90/10 | 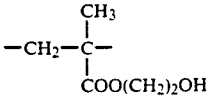 |

TABLE 3-continued

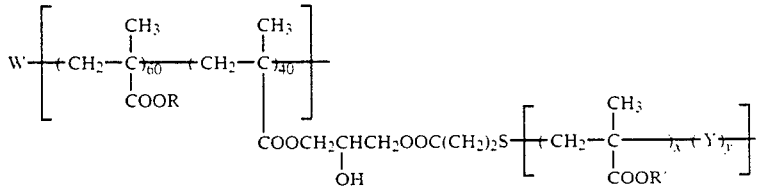

| Resin (A) | W— | R | R' | x/y (by weight) | —Y— |
|---|---|---|---|---|---|
| A-24 | " | 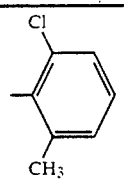 | 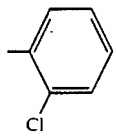 | 90/10 | 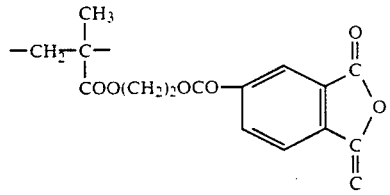 |
| A-25 | " | 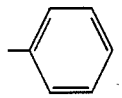 | $-CH_2C_6H_5$ | 85/15 | 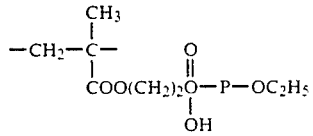 |
| A-26 | $HOOC(CH_2)_2S-$ | 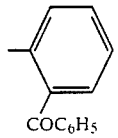 | $-C_4H_9$ | 95/5 | 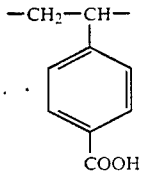 |
| A-27 | " | 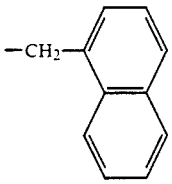 | 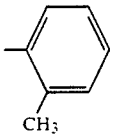 | 95/5 | 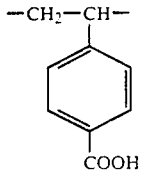 |

SYNTHESIS EXAMPLE 1 OF MACROMONOMER (MB)

Synthesis of Macromonomer M-1

A mixture of 95 g of methyl methacrylate, 5 g of thioglycolic acid, and 200 g of toluene was heated to 75° C. with stirring in a nitrogen stream. To the mixture was added 1.0 g of ACV to conduct a reaction for 8 hours. To the reaction mixture were added 8 g of glycidyl methacrylate, 1.0 g of N,N-dimethyldodecylamine, and 0.5 g of t-butylhydroquinone, followed by stirring at 100° C. for 12 hours. After cooling, the reaction mixture was re-precipitated in 2 l of methanol to obtain 82 g of a polymer (M-1) having a number average molecular weight of 6,500 as a white powder.

SYNTHESIS EXAMPLE 2 OF MACROMONOMER (MB)

Synthesis of Macromonomer M-2

A mixture of 95 g of methyl methacrylate, 5 g of thioglycolic acid, and 200 g of toluene was heated to 70° C. with stirring in a nitrogen stream. To the mixture was added 1.5 g of AIBN to conduct a reaction for 8 hours. To the reaction mixture were added 7.5 g of glycidyl methacrylate, 1.0 g of N,N-dimethyldodecylamine, and 0.8 g of t-butylhydroquinone, followed by stirring at 100° C. for 12 hours. After cooling, the reaction mixture was re-precipitated in 2 l of methanol to obtain 85 g of a polymer (M-2) having a number average molecular weight of 2,400 as a colorless clear viscous substance.

SYNTHESIS EXAMPLE 3 OF MACROMONOMER (MB)

Synthesis of Macromonomer M-3

A mixture of 94 g of propyl methacrylate, 6 g of 2-mercaptoethanol, and 200 g of toluene was heated to 70° C. in a nitrogen stream. To the mixture was added 1.2 g of AIBN to conduct a reaction for 8 hours.

The reaction mixture was cooled to 20° C. in a water bath, 10.2 g of triethylamine was added thereto, and 14.5 g of methacryl chloride was added thereto dropwise with stirring at a temperature of 25° C. or less. After the dropwise addition, the stirring was continued for 1 hour. Then, 0.5 g of t-butylhydroquinone was added, followed by stirring for 4 hours at a temperature elevated to 60° C. After cooling, the reaction mixture was re-precipitated in 2 l of methanol to obtain 79 g of a polymer (M-3) having a number average molecular weight of 4,500 as a colorless clear viscous substance.

SYNTHESIS EXAMPLE 4 OF MACROMONOMER (MB)

Synthesis of Macromonomer M-4

A mixture of 95 g of ethyl methacrylate and 200 g of toluene was heated to 70° C. in a nitrogen stream, and 5 g of 2,2'-azobis(cyanoheptanol) was added thereto to conduct a reaction for 8 hours.

After cooling, the reaction mixture was cooled to 20° C. in a water bath, and 1.0 g of triethylamine and 21 g of methacrylic anhydride were added thereto, followed by stirring at that temperature for 1 hour and then at 60° C. for 6 hours.

The resulting reaction mixture was cooled and re-precipitated in 2 l of methanol to obtain 75 g of a polymer (M-4) having a number average molecular weight of 6,200 as a colorless clear viscous substance.

SYNTHESIS EXAMPLE 5 OF MACROMONOMER (MB)

Synthesis of Macromonomer M-5

A mixture of 93 g of benzyl methacrylate, 7 g of 3-mercaptopropionic acid, 170 g of toluene, and 30 g of isopropanol was heated to 70° C. in a nitrogen stream to prepare a uniform solution. To the solution was added 2.0 g of AIBN to conduct a reaction for 8 hours. After cooling, the reaction mixture was re-precipitated in 2 l of methanol, and the solvent was removed by distillation at 50° C. under reduced pressure. The resulting viscous substance was dissolved in 200 g of toluene, and to the solution were added 16 g of glycidyl methacrylate, 1.0 g of N,N-dimethyldodecyl methacrylate, and 1.0 g of t-butylhydroquinone, followed by stirring at 110° C. for 10 hours. The reaction was again re-precipitated in 2 l of methanol to obtain a polymer (M-5) having a number average molecular weight of 3,400 as a light yellow viscous substance.

SYNTHESIS EXAMPLE 6 OF MACROMONOMER (MB)

Synthesis of Macromonomer M-6

A mixture of 95 g of propyl methacrylate, 5 g of thioglycolic acid, and 200 g of toluene was heated to 70° C. with stirring in a nitrogen stream, and 1.0 g of AIBN was added thereto to conduct a reaction for 8 hours. To the reaction mixture were added 13 g of glycidyl methacrylate, 1.0 g of N,N-dimethyldodecylamine, and 1.0 g of t-butylhydroquinone, followed by stirring at 110° C. for 10 hours. After cooling, the reaction mixture was re-precipitated in 2 l of methanol to obtain 86 g of a polymer (M-6) having a number average molecular weight of 3,500 as a white powder.

SYNTHESIS EXAMPLE 7 OF MACROMONOMER (MB)

Synthesis of Macromonomer M-7

A mixture of 40 g of methyl methacrylate, 54 g of ethyl methacrylate, 6 g of 2-mercaptoethylamine, 150 g of toluene, and 50 g of tetrahydrofuran was heated to 75° C. with stirring in a nitrogen stream, and 2.0 g of AIBN was added thereto to conduct a reaction for 8 hours. The reaction mixture was cooled to 20° C. in a water bath, and 23 g g of methacrylic anhydride was added thereto dropwise in such a manner that the temperature might not exceed 25° C., followed by stirring at that temperature for 1 hour. To the reaction mixture was added 0.5 g of 2,2'-methyelnebis(6-t-butyl-p-cresol) was added, followed by stirring at 40° C. for 3 hours. After cooling, the reaction mixture was re-precipitated in 2 l of methanol to obtain 83 g of a polymer (M-7) having a number average molecular weight of 2,200 as a viscous substance.

SYNTHESIS EXAMPLE OF MACROMONOMER (MB)

Synthesis of Macromonomer M-8

A mixture of 95 g of 2-chlorophenyl methacrylate, 150 g of toluene, and 150 g of ethanol was heated to 75° C. in a nitrogen stream, and 5 g of ACV was added thereto to conduct a reaction for 8 hours. Then, 15 g of glycidyl acrylate, 1.0 g of N,N-dimethyldodecylamine, and 1.0 g of 2,2'-methylenebis-(6-t-butyl-p-cresol) were added thereto, followed by stirring at 100° C. for 15 hours. After cooling, the reaction mixture was re-precipitated in 2 l of methanol to obtain 83 g of a polymer (M-8) having a number average molecular weight of 3,600 as a clear viscous substance.

SYNTHESIS EXAMPLES 9 TO 18 OF MACROMONOMER (MB)

Synthesis of Macromonomers M-9 to M-18

Macromonomers (M-9) to (M-18) were prepared in the same manner as in Synthesis Example 3 of Macromonomer (MB), except for replacing methacryl chloride with each of acid halides shown in Table 4 below. The resulting macromonomers had a weight average molecular weight (Mw) of from 4,000 to 5,000.

TABLE 4

| Synthesis Example No. | Macro-monomer (MB) No. | Acid Halide | Amount Used (g) | Yield (g) |
|---|---|---|---|---|
| 9 | M-9 | $CH_2{=}CH{-}COCl$ | 13.5 | 75 |
| 10 | M-10 | $CH_3$ \| $CH{=}CH{-}COCl$ | 14.5 | 80 |
| 11 | M-11 | 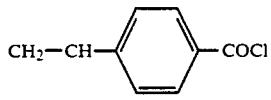 | 15.0 | 83 |
| 12 | M-12 | $CH_2{=}CH$ \| $COO(CH_2)_2COCl$ | 15.5 | 73 |

TABLE 4-continued

| Synthesis Example No. | Macro-monomer (MB) No. | Acid Halide | Amount Used (g) | Yield (g) |
|---|---|---|---|---|
| 13 | M-13 | $CH_2{=}C(CH_3)COO(CH_2)_2COCl$ | 18.0 | 75 |
| 14 | M-14 | $CH_2{=}C(CH_3)CONH(CH_2)_4COCl$ | 18.0 | 80 |
| 15 | M-15 | 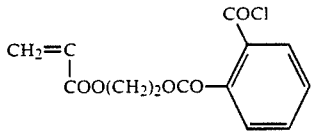 | 20.0 | 81 |
| 16 | M-16 | $CH_2{=}C(CH_3)COOCH_2CH(Br)CH_2OCO(CH_2)_3COCl$ | 20.0 | 78 |
| 17 | M-17 | $CH_2{=}CH{-}CH_2OCO(CH_2)_2COCl$ | 16.0 | 72 |
| 18 | M-18 | $CH_2{=}C(CH_2COOCH_3){-}COCl$ | 17.5 | 75 |

SYNTHESIS EXAMPLES 19 TO 27 OF MACROMONOMER (MB)

Synthesis of Macromonomer M-19 to M-27

Macromonomers M-19 to M-27 were prepared in the same manner as in synthesis Example 2 of Macromonomer (MB), except for replacing methyl methacrylate with each of monomers shown in Table 5 below.

TABLE 5

| Synthesis Example No. | Macro-monomer (MB) | Monomer (Amount: g) | Weight Average Mol. Wt. |
|---|---|---|---|
| 19 | M-19 | Ethyl methacrylate (95) | 2,800 |
| 20 | M-20 | Methyl methacrylate (60)<br>Butyl methacrylate (35) | 3,200 |
| 21 | M-21 | Butyl methacrylate (85)<br>2-Hydroxyethyl methacrylate (10) | 3,300 |
| 22 | M-22 | Ethyl methacrylate (75)<br>Styrene (20) | 2,200 |
| 23 | M-23 | Methyl methacrylate (80)<br>Methyl acrylate (15) | 2,500 |
| 24 | M-24 | Ethyl acrylate (75)<br>Acrylonitrile (20) | 3,000 |
| 25 | M-25 | Propyl methacrylate (87) | 2,200 |

TABLE 5-continued

| Synthesis Example No. | Macro-monomer (MB) | Monomer (Amount: g) | Weight Average Mol. Wt. |
|---|---|---|---|
| | | N,N-Dimethylaminoethyl methacrylate (8) | |
| 26 | M-26 | Butyl methacrylate (90)<br>N-Vinylpyrrolidone (5) | 3,000 |
| 27 | M-27 | Methyl methacrylate (89)<br>Dodecyl methacrylate (6) | 3,000 |

SYNTHESIS EXAMPLE 1 OF RESIN (B)

Synthesis of Resin B-1

A mixture of 70 g of ethyl methacrylate, 30 g of M-1 and 150 g of toluene was heated to 70° C. in a nitrogen stream, and 0.5 g of AIBN was added thereto to conduct a reaction for 4 hours. To the reaction mixture was further added 0.3 g of AIBN to conduct a reaction for 6 hours. The resulting copolymer (B-1) had a weight average molecular weight of $9.8\times10^4$ and a glass transition point of 72° C. (B-1):

(B-1):

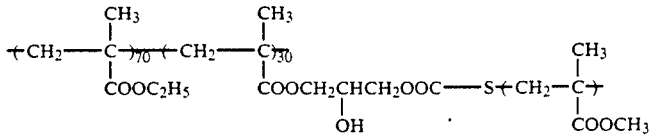

(weight composition ratio)

SYNTHESIS EXAMPLES 2 TO 15 OF RESIN (B)

Synthesis of Resins B-2 to B-15

Resins (B) shown in Table 6 were prepared under the same polymerization conditions as in Synthesis Example 1 of Resin (B). The resulting resins had a weight average molecular weight of from $8\times10^4$ to $1.5\times10^5$.

TABLE 6

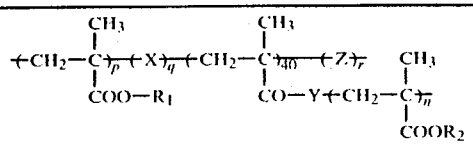

| Synthesis Example No. | Resin (B) | $R_1$ | p | $\leftarrow X \rightarrow$ | q | Y | $R_2$ | Z | r |
|---|---|---|---|---|---|---|---|---|---|
| 2 | B-2 | $-CH_3$ | 60 | — | 0 | $-OCH_2CH(OH)CH_2OOC-CH_2-S-$ | $-C_4H_9$ | — | 0 |
| 3 | B-3 | 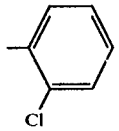 | 60 | — | 0 | " | $-C_3H_7$ | — | 0 |
| 4 | B-4 | $-C_2H_5$ | 60 | — | 0 | " | $-C_2H_5$ | — | 0 |
| 5 | B-5 | $-C_2H_5$ | 50 | $\leftarrow CH_2-CH \rightarrow$ 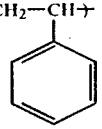 | 10 | $-OCH_2CH(OH)CH_2OOC-CH_2-S-$ | $-C_2H_5$ | — | 0 |
| 6 | B-6 | 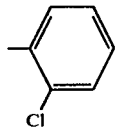 | 50 | $\leftarrow CH_2-CH(COOCH_3) \rightarrow$ | 10 | " | " | — | 0 |
| 7 | B-7 | $-CH_2C_6H_5$ | 60 | — | 0 | " | " | — | 0 |
| 8 | B-8 | $-C_2H_5$ | 59.2 | $\leftarrow CH_2-CH(COOCH_3) \rightarrow$ | 10 | $-OCH_2CH(OH)CH_2OOC-CH_2-S-$ | $-C_2H_5$ | $\leftarrow CH_2-CH(COOH) \rightarrow$ | |
| 9 | B-9 | $-C_2H_5$ | 45 | $\leftarrow CH_2-CH(CN) \rightarrow$ | 15 | $-OCH_2CH_2-S-$ | 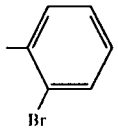 | — | 0 |

TABLE 6-continued
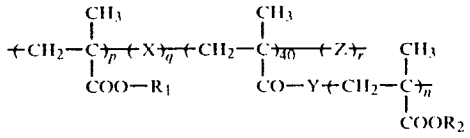
| Synthesis Example No. | Resin (B) | $R_1$ | p | X | q | Y | $R_2$ | Z | r |
|---|---|---|---|---|---|---|---|---|---|
| 10 | B-10 | $-CH_3$ | 49.5 | 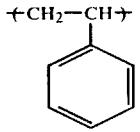 | 10 | $-NHCH_2CH_2-S-$ | $-C_4H_9$ | 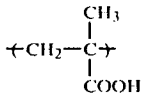 | 0.5 |
| 11 | B-11 | 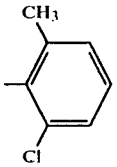 | 57 | — | 0 | 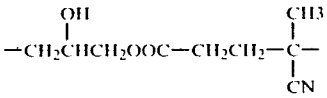 | $-CH_2C_6H_5$ | 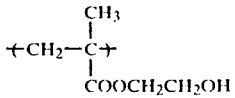 | 3 |
| 12 | B-12 | $-C_3H_7$ | 45 | 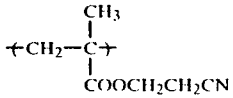 | 15 | " | $-C_2H_5$ | — | 0 |
| 13 | B-13 | $-C_2H_5$ | 40 | 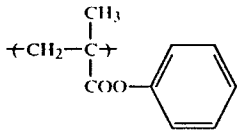 | 15 | 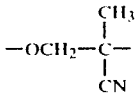 | $-C_3H_7$ | 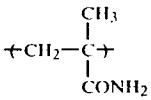 | 5 |
| 14 | B-14 | $-CH_3$ | 49.5 | 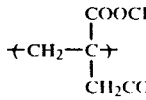 | 10 | 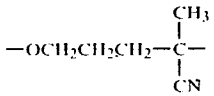 | $-C_4H_9$ | 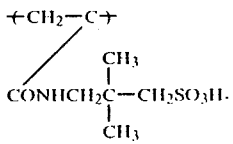 | 0.5 |
| 15 | B-15 | $-C_3H_7$ | 50 | 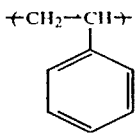 | 10 | 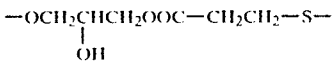 | 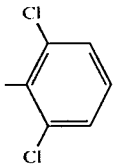 | — | 0 |

SYNTHESIS EXAMPLE 16 OF RESIN (B)

Synthesis of Resin B-16

A mixture of 70 g of ethyl methacrylate, 30 g of M-2, 150 g of toluene, and 50 g of isopropanol was heated to 70° C. in a nitrogen stream, and 0.8 g of 4,4'-azobis(4-cyanovaleric acid) was added thereto to conduct a reaction for 10 hours. The resulting copolymer (B-16) had a weight average molecular weight of $9.8\times10^4$. (B-16):

(B-16):

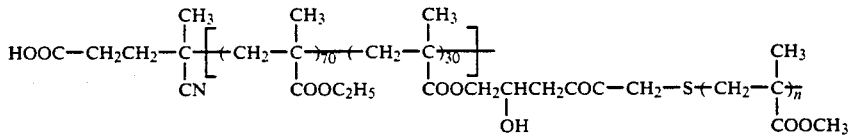

SYNTHESIS EXAMPLES 17 TO 24 OF RESIN (B)

Synthesis of Resins B-17 to B-24

Resins (B) shown in Table 7 below were prepared in the same manner as in Synthesis Example 16 of Resin (B), except for replacing M-2 with each of macromonomers shown in Table 7. The resulting resins had a weight average molecular weight of from $9\times10^4$ to $1.2\times10^5$.

TABLE 7

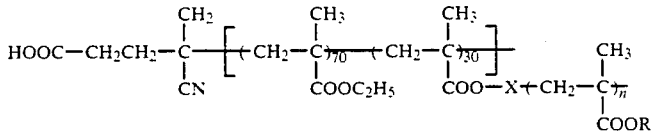

| Synthesis Example No. | Resin (B) | Macro-monomer | —X— | —R |
|---|---|---|---|---|
| 17 | B-17 | M-3 | $-CH_2CH_2-S-$ | $-C_4H_9$ |
| 18 | B-18 | M-4 | $-CH_2CH_2CH_2C(CH_3)(CN)-$ | $-C_2H_5$ |
| 19 | B-19 | M-5 | $-CH_2CH_2-S-$ | $-CH_2C_6H_5$ |
| 20 | B-20 | M-6 | $-CH_2CH(OH)CH_2OOC-CH_2-S-$ | $-C_3H_7$ |
| 21 | B-21 | M-28 | $-CH_2CH(OH)CH_2OOC-CH_2-S-$ | 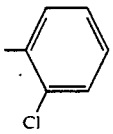 |
| 22 | B-22 | M-29 | " | $-C_4H_9$ |
| 23 | B-23 | M-30 | " | $-CH_2C_6H_5$ |
| 24 | B-24 | M-32 | " | $-C_6H_5$ |

SYNTHESIS EXAMPLES 25 TO 31 OF RESIN (B)

Synthesis of Resins B-25 to B-31

Resins (B) shown in Table 8 below were prepared in the same manner as in Synthesis Example 16 of Resin (B), except for replacing ACV with each of azobis compounds shown in Table 8.

TABLE 8

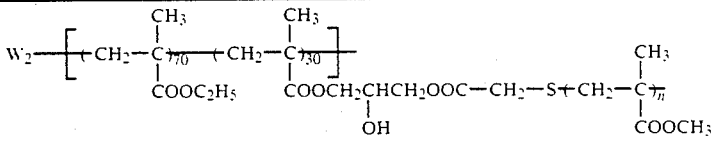

| Synthesis Example No. | Resin (B) | Azobis Compound | $W_2$— | Mw |
|---|---|---|---|---|
| 25 | B-25 | 2,2'-Azobis(2-cyanopropanol) | 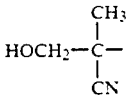 | $10.5 \times 10^4$ |
| 26 | B-26 | 2,2'-Azobis(2-cyanobutanol) | 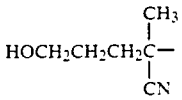 | $10 \times 10^4$ |
| 27 | B-27 | 2,2'-Azobis{2-methyl-N-[1,1-bis(hydroxymethyl)-2-hydroxyethyl]propionamide} | 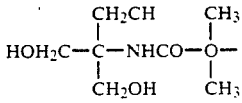 | $9 \times 10^4$ |
| 28 | B-28 | 2,2'-Azobis{2-methyl-N-(2-hydroxyethyl)propionamide} | 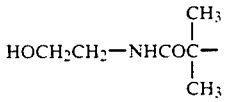 | $9.5 \times 10^4$ |
| 29 | B-29 | 2,2'-Azobis{2-methyl-N-[1,1-bis(hydroxymethyl)ethyl]-propionamide} | 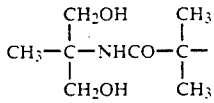 | $8.5 \times 10^4$ |
| 30 | B-30 | 2,2'-Azobis]2-(5-hydroxy-3,4,5,6-tetrahydropyrimidin-2-yl]propane | 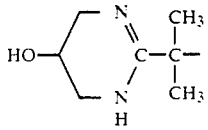 | $8.0 \times 10^4$ |
| 31 | B-31 | 2,2'-Azobis{2-[1-(2-hydroxyethyl)-2-imidazolin-2-yl]-propane} | 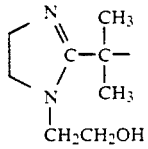 | $7.5 \times 10^4$ |

SYNTHESIS EXAMPLE 32 OF RESIN (B)

Synthesis of Resin B-32

A mixture of 80 g of butyl methacrylate, 20 g of M-8, 1.0 g of thioglycolic acid, 100 of toluene, and 50 g of isopropanol was heated to 80° C. in a nitrogen stream, and 0.5 g of 1,1'-azobis(cyclohexane-1-carbonitrile) (hereinafter abbreviated as ACHN) was added to the solution, followed by stirring for 4 hours. To the mixture was further added 0.3 g of ACHN, followed by stirring for 4 hours. The resulting polymer (B-32) had a weight average molecular weight of $8.0 \times 10^4$ and a glass transition point of 41°. (B-32):

(B-32):

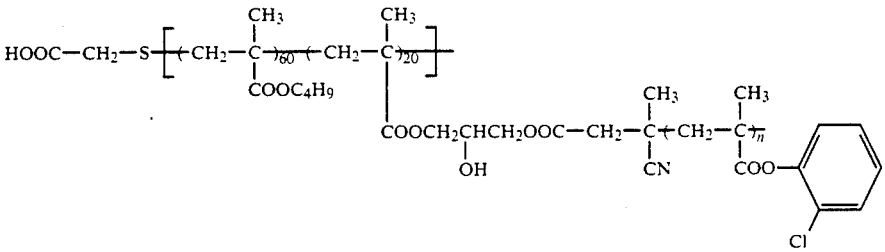

SYNTHESIS EXAMPLES 33 TO 39 OF RESIN (B)

Synthesis of Resins (B-33) to (B-39)

Resins (B) were synthesized in the same manner as in Synthesis Example 32 of Resin (B), except for replacing thioglycolic acid with each of compounds shown in Table 9 below.

SYNTHESIS EXAMPLES 40 TO 48 OF RESIN (B)

Synthesis of Resins B-40 to B-48

Copolymers of Table 10 below were prepared under the same polymerization conditions as in Synthesis Example 26 of Resin (B). The resulting resins had a weight average molecular weight of from $9.5 \times 10^4$ to $1.2 \times 10^5$.

TABLE 9

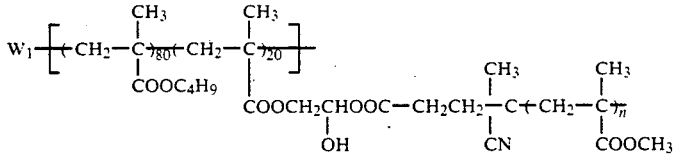

| Synthesis Example No. | Resin (B) | Mercaptane Compound | $W_1$— | Mw |
|---|---|---|---|---|
| 33 | B-33 | 3-Mercaptopropionic acid | HOOC—$CH_2CH_2$—S— | $8.5 \times 10^4$ |
| 34 | B-34 | 2-Mercaptosuccinic acid | HOOC—HC(HOOC—$CH_2$)—S— | $10 \times 10^4$ |
| 35 | B-35 | Thiosalicylic acid | 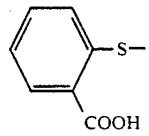 | $9 \times 10^4$ |
| 36 | B-36 | 2-Mercaptoethanesulfonic acid pyridine salt | 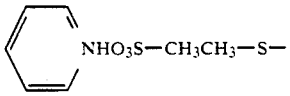 | $8 \times 10^4$ |
| 37 | B-37 | $HSCH_2CH_2CONHCH_2COOH$ | $HOOCH_2CNHCOCH_2CH_2$—S— | $9.5 \times 10^4$ |
| 38 | B-38 | 2-Mercaptoethanol | HO—$CH_2CH_2$—S— | $9 \times 10^4$ |
| 39 | B-39 | $HSCH_2CH_2COOCH_2CH_2$—O(=O)(OH)—P—OH | HO—P(=O)(OH)—$OCH_2CH_2COCCH_2CH_2$—S— | $10.5 \times 10^4$ |

TABLE 10

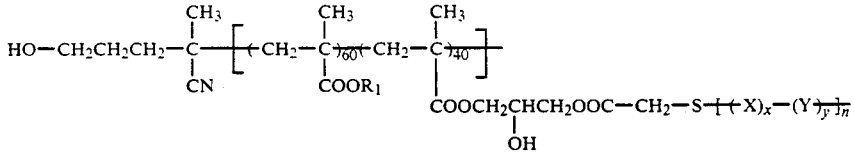

| Synthesis Example No. | Resin (B) | $R_1$ | X | x | Y | y |
|---|---|---|---|---|---|---|
| 40 | B-40 | $-C_2H_5$ | 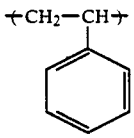 | 20 | 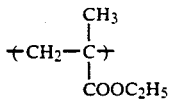 | 80 |
| 41 | B-41 | $-C_2H_5$ | 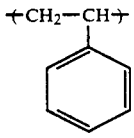 | 40 | 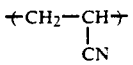 | 60 |

TABLE 10-continued

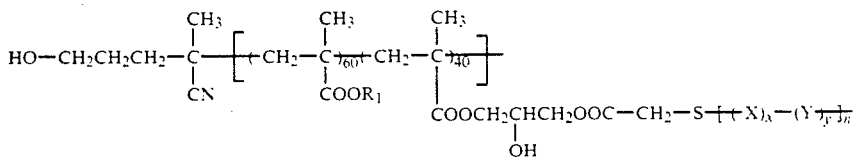

| Synthesis Example No. | Resin (B) | $R_1$ | X | x | Y | y |
|---|---|---|---|---|---|---|
| 42 | B-42 | $-C_2H_5$ | $\leftarrow CH_2-C(CH_3)(COOCH_3)\rightarrow$ | 90 | $\leftarrow CH_2-CH(COOCH_3)\rightarrow$ | 10 |
| 43 | B-43 | $-C_3H_7$ | $\leftarrow CH_2-CH\rightarrow$ 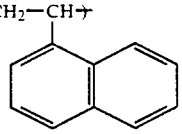 | 100 | — | 0 |
| 44 | B-44 | $-C_3H_7$ | $\leftarrow CH_2-C(CH_3)(COOCH_2CH_2CN)\rightarrow$ | 50 | $\leftarrow CH_2-C(CH_3)(COOC_4H_9)\rightarrow$ | 50 |
| 45 | B-45 | $-C_2H_5$ | $\leftarrow CH_2-C(CH_3)(COOC_3H_7)\rightarrow$ | 85 | $\leftarrow CH_2-C(CH_3)(COOCH_2CH_2N(CH_3)_2)\rightarrow$ | 75 |
| 46 | B-46 | $-C_2H_5$ | $\leftarrow CH_2-C(CH_3)(COOC_2H_5)\rightarrow$ | 90 | $\leftarrow CH_2-CH\rightarrow$ 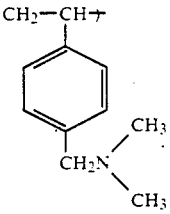 | 10 |
| 47 | B-47 | $-C_3H_7$ | $\leftarrow CH_2-C(CH_3)(COOC_2H_5)\rightarrow$ | 90 | $\leftarrow CH_2-C(CH_3)(COOCH_2CH_2SO_2CH_3)\rightarrow$ | 10 |
| 48 | B-48 | $-C_2H_5$ | $\leftarrow CH_2-C(CH_3)(COOC_3H_7)\rightarrow$ | 75 | $\leftarrow CH_2-C(CH_3)(CONH_2)\rightarrow$ | 15 |

SYNTHESIS EXAMPLES 49 TO 56 OF RESIN (B)

Synthesis of Resins B-49 to B-56

Resins of Table 11 below were synthesized under the same polymerization conditions as in Synthesis Example 16 of Resin (B). The resulting resins had a weight average molecular weight of from $9.5\times10^4$ to $1.1\times10^5$.

TABLE 11

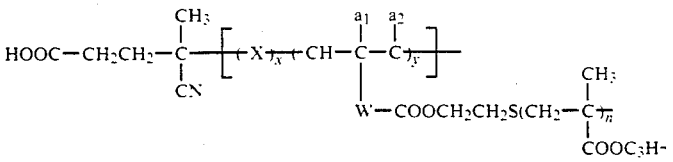

| Synthesis Example No. | Resin (B) | —X— | $a_1$ | $a_2$ | —W— | x/y (by weight) | Macro-monomer Used |
|---|---|---|---|---|---|---|---|
| 49 | B-49 | $-CH_2-C(CH_3)(COOC_2H_5)-$ | H | H | — | 80/20 | M-9 |
| 50 | B-50 | " | $CH_3$ | H | — | 70/30 | M-10 |
| 51 | B-51 | $-CH_2-CH-$ 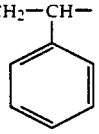 | H | H | 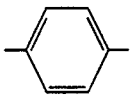 | 60/40 | M-11 |
| 52 | B-52 | $-CH_2-C(CH_3)(COOC_2H_5)-$ | H | H | $-COOCH_2CH_2-$ | 80/20 | M-12 |
| 53 | B-53 | $-CH_2-C(CH_3)(COOC_2H_5)-$ | H | $CH_3$ | $-COO(CH_2)_2OCO(CH_2)_2-$ | 80/20 | M-13 |
| 54 | B-54 | $-CH_2-C(CH_3)(COOC_2H_5)-$ | H | $CH_3$ | $-CONH(CH_2)_4-$ | 80/20 | M-14 |
| 55 | B-55 | $-CH_2-C(CH_3)(COOCH_3)-$ | H | H | $-COO(CH_2)_2OCO-$ 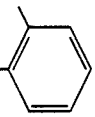 | 50/50 | M-15 |
| 56 | M-56 | $-CH_2-CH-$ 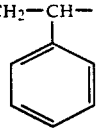 | H | H | $-CH_2OCO(CH_2)_2-$ | 80/20 | M-17 |

EXAMPLE 1

A mixture of 6 g (solid basis, hereinafter the same) of A-2 obtained in Synthesis Example 2 of Resin (A), 34 g (solid basis, hereinafter the same) of B-1 obtained in Synthesis Example of 1 of Resin (B), 200 g of zinc oxide, 0.018 g of cyanine dye (A) shown below, 0.40 g of phthalic anhydride, and 300 g of toluene was dispersed in a ball mill for 3 hours to prepare a coating composition for a photoconductive layer. The coating composition was coated on paper, rendered electrically conductive, with a wire bar to a dry thickness of 20 g/m$^2$, followed by drying at 110° C. for 30 seconds. The coating was allowed to stand in a dark plate at 20° C. and 65% RH (relative humidity) for 24 hours to prepare an electrophotographic light-sensitive material. Cyanine Dye (A):

Cyanine Dye (A):

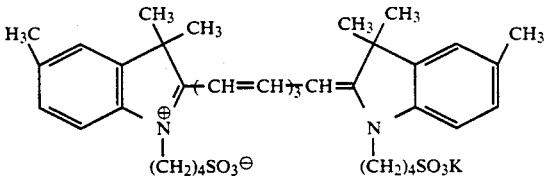

EXAMPLE 2

An electrophotographic light-sensitive material was produced in the same manner as in Example 1, except for replacing 34 g of B-1 with 34 g of B-16.

COMPARATIVE EXAMPLE A

An electrophotographic light-sensitive material (designated Sample A) was produced in the same manner as in Example 1, except for replacing A-2 and B-1 with 40 g of A-2 alone.

COMPARATIVE EXAMPLE B

An electrophotographic light-sensitive material (designated Sample B) was produced in the same manner as in Example 1, except for using 40 g of resin R-1 shown below as a sole binder resin. (R-1):

(R-1):

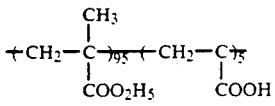

(weight composition ratio)

M.W. 6,500 Tg: 40° C.

COMPARATIVE EXAMPLE C

An electrophotographic light-sensitive material (designated Sample C) was produced in the same manner as in Comparative Example A, except for using 6 g of R-1 and 34 g of B-1 as binder resins.

COMPARATIVE EXAMPLE D

An electrophotographic light-sensitive material (designated Sample D) was produced in the same manner as in Example 1, except for using 40 g of resin (R-2) shown below as a sole binder resin.

(R-2):

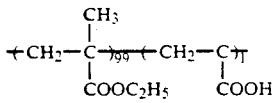

(weight composition ratio)

M.W. 4,500 Tg: 46° C.

Each of the light-sensitive materials obtained in Examples 1 and 2 and Comparative Examples A to D was evaluated for film properties in terms of surface smoothness and mechanical strength; electrostatic characteristics; image forming performance; and electrostatic characteristics and image forming performance when processed under conditions of 30° C. and 80% RH according to the following test methods. Further, oil-desensitivity (contact angle with water after oil-desensitization treatment) and printing suitability (background stains and printing durability) of the light-sensitive material when used as an offset master plate precursor were also evaluated according to the following test methods. The results obtained are shown in Table 12 below.

1) Smoothness of Photoconductive Layer:

The smoothness (sec/cc) was measured using a Beck's smoothness tester manufactured by Kumagaya Riko K. K. under an air volume condition of 1 cc.

2) Mechanical Strength of Photoconductive Layer:

The surface of the light-sensitive material was repeatedly (1000 times) rubbed with emery paper (#1000) under a load of 50 g/cm$^2$ using a Heidon 14 Model surface testing machine (manufactured by Shinto Kagaku K. K.). After dusting, the abrasion loss of the photoconductive layer was measured to obtain film retention (%).

3) Electrostatic Characteristics:

The sample was charged with a corona discharge to a voltage of −6 kV for 20 seconds in a dark room at 20° C. and 65% RH using a paper analyzer "Paper Analyzer SP-428" manufactured by Kawaguchi Denki K. K. Ten seconds after the corona discharge, the surface potential $V_{10}$ was measured. The sample was allowed to stand in the dark for an additional 120 seconds, and the potential $V_{130}$ was measured. The dark decay retention (DRR; %), i.e., percent retention of potential after dark decay for 120 seconds, was calculated from the following equation:

$$DRR(\%)=(V_{130}/V_{10})\times 100$$

The measurements were conducted under conditions of 20° C. and 65% RH (hereinafter referred to as Condition I) or 30° C. and 80% RH (hereinafter referred to as Condition II).

Separately, the sample was charged to −400 V with a corona discharge and then exposed to monochromatic light having a wavelength of 780 nm, and the time required for decay of the surface potential $V_{10}$ to one-tenth was measured to obtain an exposure amount $E_{1/10}$ (erg/cm$^2$).

4) Image Forming Performance:

After the sample was allowed to stand for one day under Condition I or II, each sample was charged to −5 kV and exposed to light emitted from a gallium-aluminum-arsenide semi-conductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer "ELP-T" produced by Fuji Photo Film Co., Ltd., followed by fixing. The reproduced image was visually evaluated for fog and image quality.

5) Contact Angle With Water:

The sample was passed once through an etching processor using an oil-desensitizing solution "ELP-E" (produced by Fuji Photo Film Co., Ltd.) 2-fold diluted with distilled water to render the surface of the photoconductive layer oil-desensitive. On the thus oil-desensitized surface was placed a drop of 2 μl of distilled water, and the contact angle formed between the surface and water was measured using a goniometer.

6) Printing Durability:

The sample was processed to form a toner image in the same manner as described in 4) above, and the surface of the photoconductive layer was subjected to oil-desensitization under the same conditions as in 5) above. The resulting lithographic printing plate was mounted on an offset printing machine "Oliver Model 52", manufactured by Sakurai Seisakusho K. K., and printing was carried out on fine paper. The number of prints obtained until background stains in the non-image areas appeared or the quality of the image areas was deteriorated was taken as the printing durability. The larger the number of the prints, the higher the printing durability.

TABLE 12

| | Example 1 | Example 2 | Compa. Example A | Compa. Example B | Compa. Example C | Compa. Example D |
|---|---|---|---|---|---|---|
| Surface Smoothness (sec/cc) | 115 | 120 | 125 | 120 | 120 | 45 |
| Film Strength (%) | 89 | 97 | 65 | 60 | 96 | 65 |
| Electrostatic Characteristics: | | | | | | |
| $V_{10}$ (−V): | | | | | | |
| Condition I | 575 | 575 | 580 | 520 | 510 | 500 |
| Condition II | 570 | 575 | 580 | 435 | 420 | 230 |
| DRR (%): | | | | | | |
| Condition I | 83 | 84 | 85 | 76 | 75 | 45 |
| Condition II | 80 | 83 | 85 | 68 | 63 | 10 |
| $E_{1/10}$ (erg/cm$^2$): | | | | | | |
| Condition I | 22 | 21 | 20 | 50 | 53 | 115 |
| Condition II | 23 | 21 | 20 | 55 | 60 | 200 or more |
| Image-Forming Performance: | | | | | | |
| Condition I | Good | Good | Good | No good to good (reduced $D_{max}$) | No good to good (reduced $D_{max}$) | Poor (no $D_{max}$) |
| Condition II | Good | Good | Good | No good (illegible fine lines) | No good (illegible fine lines) | Very poor (fine lines and letters disappeared, no $D_{max}$) |
| Contact Angle With Water (degree) | 10 or | 10 or | 10 or | 10 or | 11 | 23-30 (widely Varied) |
| Printing Durability: | 8,000 | 10,000 or more | 3,000 | 3,000 | 10,000 or more | Background stains from the start of printing |

As can be seen from the results of Table 12, only Sample D in which the conventional resin was used had significantly deteriorated surface smoothness and electrostatic characteristics.

Samples B and C., underwent changes of electrostatic characteristics, and particularly deterioration of DRR for 120 seconds, when processed under high-temperature and high-humidity conditions (30° C., 80% RH). As a result, image forming properties in scanning exposure were degraded.

Sample A underwent no substantial changes in electrostatic characteristics or image forming performance due to variations of environmental conditions as observed in Samples B and C. Further, it was also superior to Sample B in electrostatic characteristics when processed under normal temperature and normal humidity conditions. These superior performances are extremely effective in a scanning exposure system using a semiconductor laser beam of low output. Sample D was poor in film strength, electrostatic characteristics, and printing suitability, far below the levels for practical use.

The light-sensitive materials according to the present invention exhibited electrostatic characteristics and image forming performance equal to Sample A. When they were used as an offset master, oil-desensitization with an oil-desensitizing solution sufficiently proceeded to render the non-image area of the photoconductive layer sufficiently hydrophilic as having a contact angle with water of 10° or less. On practical printing, no background stain of prints was observed. On the other hand, Sample A had insufficient film strength and poor printing durability.

On comparing Examples 1 and 2, the sample of Example using resin (B) containing a polar group had increased film strength over that of the sample of Example 1, which lead to improved printing durability when used as an offset master.

Sample D was far below the level acceptable for practical use in all of film strength, electrostatic characteristics, and printing suitability.

From all these considerations, it is thus clear that the electrophotographic light-sensitive materials according to the present invention satisfy all of the requirements of surface smoothness, film strength, electrostatic characteristics, and printing suitability.

EXAMPLES 3 TO 22

An electrophotographic light-sensitive material was prepared in the same manner as in Example 1, except for replacing 6 g of A-2 and 34 g of B-1 with each of the resins (A) and (B) shown in Table 13, respectively, and replacing 0.018 g of cyanine dye (A) with 0.018 g of cyanine dye (B) shown below.

Cyanine Dye (B):

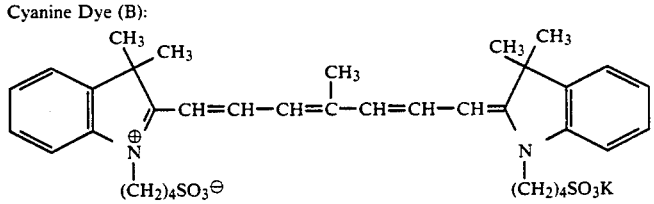

The performance properties of the resulting light-sensitive materials were evaluated in the same manner as in Example 1, and the results obtained are shown in Table 13 below. In Table 13, the electrostatic characteristics were those measured under Condition I.

TABLE 13

| Example No. | Resin (A) | Resin (B) | Film Strength (%) | $V_{10}$ (%) | DRR (erg/cm$^2$) | $E_{1/10}$ | Printing Durability |
|---|---|---|---|---|---|---|---|
| 3 | A-1 | B-2 | 88 | 550 | 80 | 33 | 8000 |
| 4 | A-3 | B-3 | 88 | 580 | 85 | 23 | 8000 |
| 5 | A-4 | B-4 | 88 | 555 | 80 | 27 | 8000 |
| 6 | A-5 | B-5 | 91 | 550 | 78 | 36 | 8300 |
| 7 | A-6 | B-6 | 87 | 555 | 79 | 35 | 8000 |
| 8 | A-7 | B-7 | 87 | 560 | 82 | 28 | 8000 |
| 9 | A-8 | B-8 | 97 | 550 | 82 | 30 | 10000 or more |
| 10 | A-9 | B-9 | 93 | 560 | 82 | 25 | 8500 |
| 11 | A-10 | B-10 | 98 | 540 | 77 | 37 | 10000 or more |
| 12 | A-12 | B-14 | 97 | 560 | 83 | 25 | 10000 or more |
| 13 | A-13 | B-15 | 90 | 565 | 83 | 22 | 8500 |
| 14 | A-14 | B-16 | 98 | 560 | 83 | 26 | 10000 or more |
| 15 | A-15 | B-18 | 96 | 575 | 85 | 22 | 10000 or more |
| 16 | A-16 | B-19 | 97 | 565 | 84 | 21 | 10000 or more |
| 17 | A-18 | B-25 | 88 | 575 | 82 | 25 | 8300 |
| 18 | A-19 | B-27 | 90 | 565 | 82 | 23 | 8500 |
| 19 | A-20 | B-29 | 90 | 550 | 81 | 26 | 8500 |
| 20 | A-21 | B-32 | 96 | 545 | 78 | 30 | 10000 or more |
| 21 | A-22 | B-35 | 97 | 560 | 82 | 26 | 10000 or more |
| 22 | A-25 | B-39 | 98 | 560 | 80 | 23 | 10000 or more |

EXAMPLES 23 TO 36

A light-sensitive material was prepared in the same manner as in Example 1, except for replacing 6 g of A-2 and 34 g of B-1 with each of resins A and B shown in Table 14 below and replacing 0.018 g of cyanine dye (A) with 0.016 g of methine dye (C) shown below.

Methine Dye (C):

Methine Dye (C):

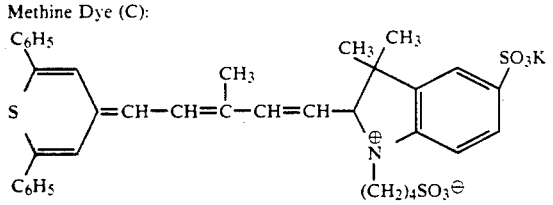

TABLE 14

| Example No. | Resin (A) | Resin (B) |
|---|---|---|
| 23 | A-26 | B-9 |
| 24 | A-27 | B-10 |
| 25 | A-22 | B-11 |
| 26 | A-27 | B-21 |
| 27 | A-2 | B-23 |
| 28 | A-6 | B-24 |
| 29 | A-6 | B-30 |
| 30 | A-7 | B-40 |
| 31 | A-7 | B-41 |
| 32 | A-9 | B-43 |
| 33 | A-18 | B-44 |
| 34 | A-19 | B-45 |
| 35 | A-23 | B-47 |
| 36 | A-24 | B-48 |

Various characteristics of the resulting samples were evaluated in the same manner as in Example 1. As a result, each sample proved almost equal to the sample of Example 1 in surface smoothness and film strength.

Further, each sample was excellent in charging properties, dark charge retention, and photosensitivity and provided a clear image free from background stains even when processed under severe conditions of high temperature and high humidity (30° C., 80% RH).

As described above, the present invention provides an electrophotographic light-sensitive material having excellent electrostatic characteristics and mechanical strength.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having thereon a photoconductive layer containing at least inorganic photoconductive particles and a binder resin, wherein the binder resin contains (A) at least one resin comprising a graft copolymer having a weight average molecular weight of from $1.0\times10^3$ to $2.0\times10^4$ and containing, as copolymer components, at least (A-i) a monofunctional macromonomer (MA) having a weight average molecular weight of not more than $2\times10^4$ and containing at least one polymer component represented by formula (IIa) or (IIb) shown below and at least one polymer component having at least one polar group selected from the group consisting of —COOH, —$PO_3H_2$, —$SO_3H$, —OH, and

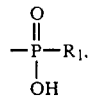

wherein $R_1$ represents a hydrocarbon group or —$OR_2$ (wherein $R_2$ represents a hydrocarbon group), with a polymerizable double bond group represented by formula (I) shown below being bonded to one terminal of the main chain thereof, and (A-ii) a monomer represented by formula (III) shown below, and (B) at least one resin comprising a copolymer containing, as copolymer components, at least (B-i) a monofunctional macromonomer (MB) having a weight average molecular weight of not more than $2\times10^4$ and containing at least one polymer component represented by formula (IIa) or (IIb) shown below, with a polymerizable double bond group represented by formula (I) shown below being bonded to one terminal of the main chain thereof and (B-ii) a monomer represented by formula (III) shown below:

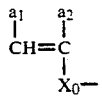

(I)

wherein $X_0$ represents —COO—, —OCO—, —$CH_2$OCO—, —$CH_2$COO—, —O—, —$SO_2$—, —CO—, —CONHCOO—, —CONHCONH—, —$CONHSO_2$,

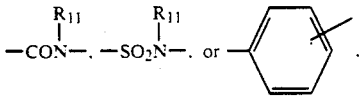

wherein $R_{11}$ represents a hydrogen atom or a hydrocarbon group; $a_1$ and $a_2$, which may be the same or different, each represents a hydrogen atom, a halogen atom, a cyano group, a hydrocarbon group, —COO—$Z_1$, or —COO—$Z_1$ bonded through a hydrocarbon group (wherein $Z_1$ represents a substituted or unsubstituted hydrocarbon group:

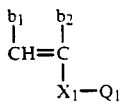

(IIa)

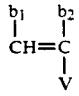

(IIb)

wherein $X_1$ has the same meaning as $X_0$; $Q_1$ represents an aliphatic group having from 1 to 18 carbon atoms or an aromatic group having from 6 to 12 carbon atoms; $b_1$ and $b_2$, which may be the same or different, each has the same meaning as $a_1$ and $a_2$; V represents —CN, —$CONH_2$, or

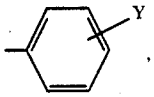

wherein Y represents a hydrogen atom, a halogen atom, a hydrocarbon group, an alkoxyl group, or —$COOZ_2$, wherein $Z_2$ represents an alkyl group, an aralkyl group, or an aryl group:

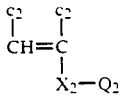

(III)

wherein $X_2$ has the same meaning as $X_0$ in formula (I); $Q_2$ has the same meaning as $Q_1$ in formula (IIa); and $c_1$ and $c_1$, which may be the same or different, have the same meaning as $a_1$ and $a_2$ in formula (I).

2. An electrophotographic light-sensitive material as claimed in claim 1, wherein resin (A) is a resin in which the graft copolymer has at least one polar group selected from the group consisting of —$PO_3H_2$, —$SO_3H$, —COOH, —OH, and

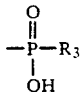

(wherein $R_3$ represents a hydrocarbon group or —$OR_4$, wherein $R_4$ represents a hydrocarbon group) at one terminal of the main chain thereof.

3. An electrophotographic light-sensitive material as claimed in claim 1, wherein resin (B) is a graft copolymer having at least one acidic group selected from the group consisting of —$PO_3H_2$, —$SO_3H$, —COOH, —OH, —SH, and

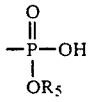

(wherein $R_5$ represents a hydrocarbon group) at one terminal of the polymer main chain thereof.

4. An electrophotographic light-sensitive material as claimed in claim 2, wherein resin (B) is a graft copolymer having at least one acidic group selected from the group consisting of —$PO_3H_2$, —$SO_3H$, —COOH, —OH, —SH, and

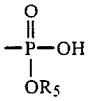

(wherein $R_5$ represents a hydrocarbon group) at one terminal of the polymer main chain thereof.

5. An electrophotographic light-sensitive material as claimed in claim 1, wherein said resin (A) contains the macromonomer (MA) in an amount of from 5 to 80% by weight.

6. An electrophotographic light-sensitive material as claimed in claim 1, wherein said macromonomer (MA) has a weight average molecular weight of from $1\times10^3$ to $2\times10^4$.

7. An electrophotographic light-sensitive material as claimed in claim 1, wherein said resin (B) has a weight average molecular weight of at least $3\times10^4$.

8. An electrophotographic light-sensitive material as claimed in claim 1, wherein said resin (B) has a weight average molecular weight of from $5\times10^4$ to $3\times10^5$.

9. An electrophotographic light-sensitive material as claimed in claim 1, wherein said resin (B) contains the macromonomer (MB) in an amount of from 1 to 80% by weight.

10. An electrophotographic light-sensitive material as claimed in claim 1, wherein said macromonomer (MB) has a weight average molecular weight of from $1\times10^3$ to $2\times10^4$.

* * * * *